US007718335B2

(12) United States Patent
Fujiwara et al.

(10) Patent No.: US 7,718,335 B2
(45) Date of Patent: May 18, 2010

(54) IMAGE BEARING MEMBER, AND IMAGE FORMING APPARATUS AND PROCESS CARTRIDGE USING THE SAME

(75) Inventors: Yukio Fujiwara, Numazu (JP); Tetsuro Suzuki, Fuji (JP); Hiroshi Tamura, Susono (JP); Hidetoshi Kami, Numazu (JP); Tetsuya Toshine, Numazu (JP); Yoshinori Inaba, Numazu (JP)

(73) Assignee: Ricoh Company Limited, Tokyo (JP)

( * ) Notice: Subject to any disclaimer, the term of this patent is extended or adjusted under 35 U.S.C. 154(b) by 612 days.

(21) Appl. No.: 11/616,523

(22) Filed: Dec. 27, 2006

(65) Prior Publication Data

US 2007/0196750 A1 Aug. 23, 2007

(30) Foreign Application Priority Data

Dec. 27, 2005 (JP) ..... 2005-374936

(51) Int. Cl.
*G03G 15/02* (2006.01)

(52) U.S. Cl. ..... 430/58.7; 430/58.05; 430/130

(58) Field of Classification Search ..... 430/58.7, 430/58.05, 130; 399/159
See application file for complete search history.

(56) References Cited

U.S. PATENT DOCUMENTS

| | | | | |
|---|---|---|---|---|
| 4,772,525 | A | 9/1988 | Badesha et al. | |
| 5,322,753 | A | 6/1994 | Tamura et al. | |
| 5,488,137 | A | 1/1996 | Tamura et al. | |
| 5,492,784 | A | 2/1996 | Yoshikawa et al. | |
| 5,608,010 | A | 3/1997 | Tamura et al. | |
| 5,871,876 | A | 2/1999 | Ikuno et al. | |
| 6,030,733 | A | 2/2000 | Kami et al. | |
| 6,066,428 | A | 5/2000 | Katayama et al. | |
| 6,151,468 | A | 11/2000 | Kami et al. | |
| 6,194,535 | B1 | 2/2001 | Katayama et al. | |
| 6,210,848 | B1 | 4/2001 | Nagai et al. | |
| 6,861,188 | B2 | 3/2005 | Ikegami et al. | |
| 6,936,388 | B2 | 8/2005 | Suzuki et al. | |
| 7,018,755 | B2 | 3/2006 | Ikegami et al. | |
| 7,175,957 | B2 * | 2/2007 | Suzuki et al. | 430/66 |
| 7,179,573 | B2 * | 2/2007 | Suzuki et al. | 430/66 |

(Continued)

FOREIGN PATENT DOCUMENTS

JP 56-48637 5/1981

(Continued)

OTHER PUBLICATIONS

U.S. Appl. No. 12/000,239, filed Dec. 11, 2007, Fujiwara, et al.

(Continued)

*Primary Examiner*—Mark A Chapman
(74) *Attorney, Agent, or Firm*—Oblon, Spivak, McClelland, Maier & Neustadt, L.L.P.

(57) ABSTRACT

An image bearing member is provided, including a substrate and a surface layer formed by optically curing at least a radical polymerizable compound with a charge transport structure and a radical polymerizable monomer without a charge transport structure, wherein the transmission factor of the surface layer for light having a wavelength by 25 nm longer than an absorption end wavelength of photo-absorption spectrum of the surface layer prior to optical curing is not less than 65%.

11 Claims, 4 Drawing Sheets

U.S. PATENT DOCUMENTS

| | | | | |
|---|---|---|---|---|
| 7,364,824 | B2 * | 4/2008 | Kikuchi et al. | 430/58.7 |
| 2004/0053152 | A1 | 3/2004 | Nagai et al. | |
| 2004/0248024 | A1 | 12/2004 | Suzuki et al. | |
| 2004/0253527 | A1 | 12/2004 | Suzuki et al. | |
| 2005/0008957 | A1 | 1/2005 | Ikegami et al. | |
| 2005/0053853 | A1 | 3/2005 | Sugino et al. | |
| 2005/0106483 | A1 | 5/2005 | Shoshi et al. | |
| 2005/0118518 | A1 | 6/2005 | Ikegami et al. | |
| 2005/0141919 | A1 | 6/2005 | Kitajima et al. | |
| 2005/0158641 | A1 | 7/2005 | Yanagawa et al. | |
| 2005/0158644 | A1 | 7/2005 | Kondo et al. | |
| 2005/0175911 | A1 | 8/2005 | Tamoto et al. | |
| 2005/0181291 | A1 | 8/2005 | Kami et al. | |
| 2005/0196193 | A1 | 9/2005 | Tamoto et al. | |
| 2005/0221210 | A1 | 10/2005 | Suzuki et al. | |
| 2005/0238987 | A1 | 10/2005 | Ohshima et al. | |
| 2005/0266325 | A1 | 12/2005 | Yanagawa et al. | |
| 2005/0266328 | A1 | 12/2005 | Yanagawa et al. | |
| 2005/0282075 | A1 | 12/2005 | Ikuno et al. | |
| 2005/0287452 | A1 | 12/2005 | Tamura et al. | |
| 2005/0287465 | A1 | 12/2005 | Ohshima et al. | |
| 2006/0014093 | A1 | 1/2006 | Li et al. | |
| 2006/0014096 | A1 | 1/2006 | Ohshima et al. | |
| 2006/0051689 | A1 | 3/2006 | Suzuki et al. | |
| 2006/0068308 | A1 | 3/2006 | Ohshima et al. | |
| 2006/0093955 | A1 | 5/2006 | Ohshima et al. | |
| 2006/0110668 | A1 | 5/2006 | Kawasaki et al. | |
| 2006/0160003 | A1 | 7/2006 | Nagai et al. | |
| 2006/0177749 | A1 | 8/2006 | Tamoto et al. | |
| 2007/0009818 | A1 * | 1/2007 | Yanagawa et al. | 430/58.05 |

FOREIGN PATENT DOCUMENTS

| | | |
|---|---|---|
| JP | 56-45219 | 10/1981 |
| JP | 1-241559 | 9/1989 |
| JP | 5-19497 | 1/1993 |
| JP | 5-60503 | 9/1993 |
| JP | 6-45770 | 6/1994 |
| JP | 6-234836 | 8/1994 |
| JP | 6-234837 | 8/1994 |
| JP | 6-234838 | 8/1994 |
| JP | 6-234839 | 8/1994 |
| JP | 6-234840 | 8/1994 |
| JP | 6-234841 | 8/1994 |
| JP | 6-236050 | 8/1994 |
| JP | 6-236051 | 8/1994 |
| JP | 6-239049 | 8/1994 |
| JP | 7-10912 | 2/1995 |
| JP | 8-269183 | 10/1996 |
| JP | 2591793 | 12/1996 |
| JP | 2596588 | 1/1997 |
| JP | 2596589 | 1/1997 |
| JP | 9-43883 | 2/1997 |
| JP | 9-302084 | 11/1997 |
| JP | 2827976 | 9/1998 |
| JP | 2865020 | 12/1998 |
| JP | 2865029 | 12/1998 |
| JP | 2889652 | 2/1999 |
| JP | 2894257 | 3/1999 |
| JP | 2958100 | 7/1999 |
| JP | 2958101 | 7/1999 |
| JP | 2000-66425 | 3/2000 |
| JP | 3058069 | 4/2000 |
| JP | 3096354 | 8/2000 |
| JP | 3124784 | 10/2000 |
| JP | 3183353 | 4/2001 |
| JP | 2001-125297 | 5/2001 |
| JP | 3189914 | 5/2001 |
| JP | 3194392 | 6/2001 |
| JP | 3224031 | 8/2001 |
| JP | 3252241 | 11/2001 |
| JP | 3253209 | 11/2001 |
| JP | 3262488 | 12/2001 |
| JP | 3286711 | 3/2002 |
| JP | 3350350 | 9/2002 |
| JP | 3350381 | 9/2002 |
| JP | 3351944 | 9/2002 |
| JP | 3351952 | 9/2002 |
| JP | 3351960 | 9/2002 |
| JP | 3352323 | 9/2002 |
| JP | 3352326 | 9/2002 |
| JP | 3357557 | 10/2002 |
| JP | 3358140 | 10/2002 |
| JP | 3368415 | 11/2002 |
| JP | 3379880 | 12/2002 |
| JP | 3422140 | 4/2003 |
| JP | 3471170 | 9/2003 |
| JP | 2004-12986 | 1/2004 |
| JP | 2004-198568 | 7/2004 |
| JP | 2004-198576 | 7/2004 |
| JP | 2004-212959 | 7/2004 |
| JP | 2004-240305 | 8/2004 |
| JP | 2004-302451 | 10/2004 |
| JP | 2005-43665 | 2/2005 |
| JP | 2005-43806 | 2/2005 |
| JP | 2005-91741 | 4/2005 |
| JP | 2005-91742 | 4/2005 |
| JP | 3689534 | 6/2005 |

OTHER PUBLICATIONS

U.S. Appl. No. 11/563,710, filed Nov. 28, 2006, Inaba, et al.
U.S. Appl. No. 12/035,016, filed Feb. 21, 2008, Iwamoto, et al.
U.S. Appl. No. 12/047,011, filed Mar. 12, 2008, Kami, et al.
U.S. Appl. No. 11/855,510, filed Sep. 14, 2007, Kami, et al.
U.S. Appl. No. 11/855,553, filed Sep. 14, 2007, Inaba, et al.

* cited by examiner

IMAGE BEARING MEMBER, AND IMAGE FORMING APPARATUS AND PROCESS CARTRIDGE USING THE SAME

BACKGROUND OF THE INVENTION

1. Field of the Invention

The present invention relates to an image bearing member, an image forming apparatus and a process cartridge.

2. Discussion of the Background

Recently, organic image bearing members (organic photoconductors (OPC)) have been superseding inorganic image bearing members in the application to photocopiers, facsimile machines, laser printers and their multi-functional machines due to good performance and various other merits. Specific reasons include optical characteristics, for example, the width of the optical absorption wavelength range and the amount of optical absorption electric characteristics, for example, high sensitivity and stable charging characteristics, the wide range of selection for materials, easy manufacturing, low cost, and non-toxicity.

On the other hand the diameter of an image bearing member has been recently reduced in accordance with reduction in the size of an image forming apparatus. On top of that, high speed and maintenance-free performance have been required. Therefore, an image bearing member having high durability is demanded.

An organic image bearing member includes a surface layer mainly formed of a low molecular weight charge transport material and an inactive polymer. Such an image bearing member is soft in general. This leads to a problem that, while an organic image bearing member is repeatedly used in the electrophotographic process, the organic image bearing member easily abrades away due to the mechanical burden on the organic image bearing member received from a developing system and a cleaning system. In addition, toner particles have been reduced in size to improve the quality of images, which requires improvement of the cleaning property and leads to an increase in the hardness of the rubber for use in a cleaning blade and the contact pressure thereof to an image bearing member. This is one of the causes which accelerates the abrasion of an image bearing member. Such abrasion of an image bearing member degrades electric characteristics thereof, for example, sensitivity and chargeability. Thereby, the image density deteriorates and background fouling occurs, resulting in abnormal images. In addition, scars locally made on an image bearing member due to abrasion invite poor cleaning performance, which leads to fouling in a streak manner on an image. In the current status, abrasion and scars on an image bearing member are rate controlling factors for replacement thereof.

Therefore, it is inevitable to decrease the abraded quantity to improve the durability of an organic image bearing member. This is an imminent issue to be solved in this area.

As technologies for improving an anti-abrasion property of a photosensitive layer, for example, (1) unexamined published Japanese patent application No. (hereinafter referred to as JOP) S56-48637 describes a surface layer containing a curing binder; (2) JOP S64-1728 describes a technology in which a polymer type charge transport material is used; and (3) JOP H04-281461 describes a surface layer in which an inorganic filler is dispersed.

In the method described in (1), due to insufficient compatibility with the charge transport material and the presence of impurities, for example, a polymerization initiator and unreacted remaining groups, the remaining voltage tends to rise and the image density tends to deteriorate.

In addition, the methods described in (2) and (3) possibly improve the anti-abrasion property of an organic image bearing member but do not improve the anti-abrasion property to a level desired therefor.

Furthermore, in the method described in (3), the remaining voltage easily rises due to the trapped charge present on the surface of an inorganic filler, which leads to the tendency of deterioration of the image density.

These technologies described in (1) to (3) do not sufficiently provide an organic image bearing member with the total durability desired therefor including electric durability and mechanical durability.

Furthermore, Japanese patent No. (hereinafter referred to as JP) 3262488 describes an image bearing member containing a polyfunctional curing type acrylate monomer to improve the anti-abrasion property and anti-damage property described in (1). In this image bearing member, the protective layer, which is provided on the photosensitive layer, contains a polyfunctional curing type acrylate monomer. However, there is a description that only the protective layer can contain a charge transport material. Furthermore, when a surface layer simply contains a charge transport material having a low molecular weight, a problem of the compatibility with the cured material arises, which causes problems such that the charge transport material having a low molecular weight precipitates, white turbidity phenomenon occurs and the mechanical strength deteriorates.

Furthermore, with regard to this image bearing member, a monomer reacts while a polymeric binder resin is contained, which causes insufficient curing and a problem of the compatibility between the cured material and the binder resin. As a result, the surface tends to be convexo-concave due to phase separation during curing and cause poor cleaning performance.

As an anti-abrasion technology for a photosensitive layer superseding these, JP 3194392 describes a method in which a charge transport layer is formed by application of a liquid containing a monomer having a carbon-carbon double bond (C═C), a charge transport material having a carbon-carbon double bond (C═C), and a binder resin. The binder resin contains a material having a carbon-carbon double bond (C═C) and reactive with the charge transport material and a material not having a carbon-carbon double bond (C═C) and non-reactive with the charge transport material. This image bearing member has a good combination of anti-abrasion property and electric characteristics and draws attention. However, when a non-reactive binder resin is used, the binder resin and a cured material formed through the reaction between the monomer and the charge transport material are not sufficiently compatible, causing phase separation. This tends to lead to the formation of a convexo-concave surface during cross-linking and result in bad cleaning performance. Additionally the binder resin prevents the curing of the monomer. The specifically described monomers are divalent monomers so that the obtained cross linking density is not sufficient and the anti-abrasion property is not satisfactory. Furthermore, even when a reactive binder resin is used since the monomer and the binder resin have a low number of functional groups, it is difficult to have a good combination of the content of linked charge transport materials and cross linking density and obtain sufficient electric characteristics and anti-abrasion properties.

JOP 2004-66425 describes a photosensitive layer containing a compound cured from a positive hole carrier transport compound having at least two chain-reaction polymerizable functional groups in one molecule.

However, since this photosensitive layer contains bulky positive hole carrier transport compounds having at least two chain reaction polymerizable functional groups, distortion may occur in the cured material, which invites a high internal stress and leads to the roughness of the surface layer and the occurrence of cracking over tire. As a result, the photosensitive layer does not have sufficient durability.

Currently these image bearing members of the background art, having a cross linking photosensitive layer in which the charge transport structure is chemically linked, are not sufficient in terms of comprehensive characteristics.

To improve the current situation, the present inventors describe a technology in JOP 2004-302451 of curing a radical polymerizable monomer having at least three functional groups which does not have a charge transport structure and a radical polymerizable compound having one functional group which has a charge transport structure. However, in the technology an irradiating device is used to cure these radical polymerizable monomers for forming the surface layer so that the characteristics of the image bearing member tend to vary depending thereon.

SUMMARY OF THE INVENTION

Because of these reasons, a need exists for an image bearing member having a good combination of a stable anti-abrasion property and electrostatic characteristics for an extended period of time, and an image forming apparatus and a process cartridge using the image bearing member.

Accordingly, an object of the present invention is to provide an image bearing member having a good combination of a stable anti-abrasion property and electrostatic characteristics for an extended period of time, and an image forming apparatus and a process cartridge using the image bearing member.

Briefly this object and other objects of the present invention as hereinafter described will become more readily apparent and can be attained, either individually or in combination thereof, by These and other objects features and advantages of the present invention will become apparent upon consideration of the following description of the preferred embodiments of the present invention taken in conjunction with the accompanying drawings.

BRIEF DESCRIPTION OF THE DRAWINGS

Various other objects, features and attendant advantages of the present invention will be more fully appreciated as the same becomes better understood from the detailed description when considered in connection with the accompanying drawings in which like reference characters designate like corresponding parts throughout and wherein:

FIG. 7 is a diagram illustrating the structure of the UV lamp system of Example 4 described later.

DETAILED DESCRIPTION OF THE INVENTION

Figure 1A:
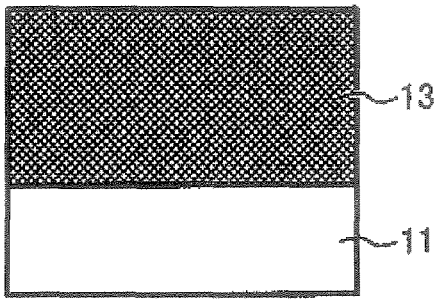
FIG. 1 is a cross section illustrating an example of the image bearing member of the present invention.

The present invention relates to an image bearing member including a substrate and a surface layer formed by optically curing at least a radical polymerizable compound with a charge transport structure and a radical polymerizable monomer without a charge transport structure. In addition, the transmission factor of the surface layer for light having a wavelength by 25 nm longer than the absorption end wavelength of photo-absorption spectrum of the surface layer prior to the optical curing is preferably not less than 65%.

It is preferred that, in the image bearing member of the present invention, the number of radical polymerizable functional groups of the radical polymerizable compound with a charge transport structure is 1.

It is further preferred that, in the present image bearing member, the number of radical polymerizable functional groups of the radical polymerizable compound without a charge transport structure is at least 3.

It is still further preferred that, in the present image bearing member, the radical polymerizable compound with a charge transport structure and the radical polymerizable compound without a charge transport structure independently have an acryloyloxy group or a methacryloyloxy group.

Further, in the image bearing member of the present invention it is even more preferred that the radical polymerizable compound with a charge transport structure has a triarylamine structure.

It is still further preferred that, in the present image bearing member, a charge generating layer, a charge transport layer and the surface layer are accumulated on the substrate in this order.

As another aspect of the present invention, an image forming apparatus is provided which includes the image bearing member mentioned above, a charging device for charging the image bearing member, an irradiating device for irradiating the image bearing member with light to form a latent image thereon, a developing device for developing the latent image with a toner, a transfer device for transferring the developed image to a recording medium and a cleaning device for cleaning the surface of the image bearing member. As another aspect of the present invention, an image forming apparatus is provided which includes the image bearing member mentioned above, at least one device selected from the group consisting of a charging device, a developing device, a transfer device, a cleaning device and a discharging device.

The present invention will be further described below in detail with reference to several embodiments and accompanying drawings.

The image bearing member of the present invention includes a substrate and a surface layer on or above the substrate and the surface layer is formed by optically curing at least a radical polymerizable compound with a charge transport structure and a radical polymerizable monomer without a charge transport structure. In addition, the transmission factor of the surface layer for light having a wavelength of 25 nm longer than the absorption end wavelength of the photo-absorption spectrum of the surface layer prior to optical curing is not less than 65% and preferably not less than 70%. The transmission factor of the surface layer can be calculated in conversion in which the layer thickness of the surface layer is 8 μm. Thereby, the image bearing member can have a good combination of anti-abrasion property and electrostatic characteristics for an extended period of time.

Figure 8:
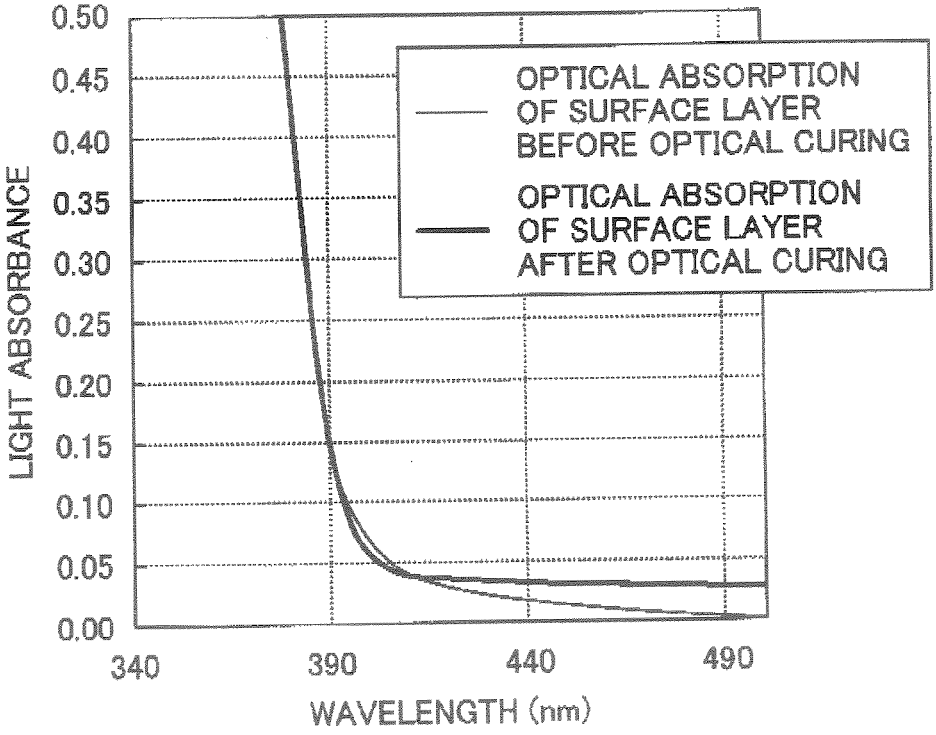
FIG. 8 BACKGROUND ART
FIG. 8 is a diagram illustrating an example of the photo-absorption spectrum of a surface layer before and after optical curing.

In general, optical curing of a surface layer causes side reactions, polymerization inhibition, oxidization, etc. due to heat ray, heat or thermal energy. The side reactions caused by heat ray or heat are considered to generate charge trap sites and to modify radical polymerizable monomer having a charge transport structure inside the surface layer or the photosensitive layer. As a result, the electric characteristics of the image bearing member deteriorate. The side reactions inhibit the progress of the curing reaction, which leads to the deterioration of the anti-abrasion property. For example, when the absorption end wavelength of photo-absorption spectrum of a surface layer prior to optical curing is 380 nm and the phenomenon is traced by the transmission factor, the transmission factor thereof for light having a wavelength of from about 370 to about 500 nm lowers. As illustrated in FIG. 8, as seen in the photo-absorption spectrum of the surface layer prior to optical curing, light having a wavelength of 25 nm longer than the absorption end wavelength is hardly absorbed in the surface layer prior to optical curing and the transmission factor thereof is high. On the other hand, in the photo-absorption spectrum of the surface layer after optical curing, the photo-absorption of light having a wavelength of at least 25 nm longer than the absorption end wavelength hardly changes.

In the present invention, it is found that an image bearing member having a good combination of the anti-abrasion property and electrostatic characteristics for an extended period of time can be obtained by making the transmission factor of the surface layer for light having a wavelength of 25 nm longer than the absorption end wavelength of photo-absorption spectrum of the surface layer prior to optical curing not to be less than 65%.

A method of manufacturing the image bearing member of the present invention includes at least; applying a liquid containing a radical polymerizable compound with a charge transport structure and a radical polymerizable monomer without a charge transport structure to a substrate; and curing the radical polymerizable compound with a charge transport structure and the radical polymerizable monomer without a charge transport structure by irradiating the substrate to which the liquid is applied with light. In this curing, it is possible to restrain the decrease in the transmission factor of the surface layer by providing an optically transparent member to separate a light source room, including a light source emitting light, from an irradiation room, in which the substrate to which the liquid is applied is irradiated with the light. This is because thermal contamination caused by heat generated in the light source room during light irradiation can be restrained and the progress of the side reactions during the curing reaction can be restrained. Also contamination on the light source by the material evaporated by light irradiation can be restrained. When a light source is contaminated, the intensity of the light emitted thereby weakens and the optical curing reaction in a surface layer may not be sufficiently conducted, which leads to deterioration of the strength of the surface layer. When the light source room and the irradiation room are not separated, the surface smoothness of the surface layer may deteriorate.

In the present invention, a cold filter can be used as an optically transparent member. Thereby, it is possible to save the irradiation of light unnecessary for curing reaction on the substrate to which a liquid of application for surface layer is applied. As a result, the deterioration of the materials for use in an image bearing member can be restrained and the decrease in the transmission factor can be further restrained.

In addition, it is preferred to cure a surface layer in an inert gas atmosphere. Thereby, the oxygen density decreases so that it is possible to restrain the reduction of the curing reaction speed and the cross linking density caused by dioxy radicals produced by oxygen that captures radicals at the reaction ends. For example, there is a method in which an inert gas is filled in an irradiation room, which can be performed by separating a light source room from the irradiation room.

Furthermore, in the present invention, such an effect obtained by filling an irradiation room with an inert gas can be obtained by curing a liquid applied to a substrate with light while spraying the inert gas at the irradiated portion thereof. This is because the oxygen density around the portion where the curing reaction is mainly conducted can be significantly decreased by spraying the inert gas thereto. Thereby, the filling time and the amount of an inert gas in an irradiation room can be reduced.

In the present invention, the absorption end wavelength of photo-absorption spectrum corresponds to the wavelength value converted from the transition energy of HOMO-LUMO peculiar to a material.

It is disputable whether band theory can be applied to a system in which a charge transport material mainly formed of organic compounds is dispersed in a resin as in the case of the image bearing member of the present invention. However, for example, as in the article "Surface Chemistry, Vol. No. 15, No. 9 issue, 565 to 572 sections (published in 1994)", it is known that the energy status of an organic compound is commonly described by the band structure thereof, which is appropriate in most cases.

In the present invention, when the following relationship is applied to the transition energy between HOMO-LUMO of an organic compound corresponding to the band gap energy in a semiconductor, the obtained result is satisfactory.

That is, in the area in which absorption is relatively significant around the optical absorption end on the long wavelength side, the absorption coefficient $\alpha$, the optical energy $h\nu$ (where h and $\nu$ represent Planck's constant and wave number, respectively) and the band gap energy $E_0$ are considered to satisfy the following relationship: $\alpha h\nu=B(h\nu-E_0)^2$, wherein B represents a constant. Therefore, the value of $h\nu$ obtained at $\alpha=0$ when the absorption spectrum is measured, $h\nu$ is plotted against $(\alpha h\nu)^{1/2}$ and the straight portion is extrapolated represents the transition energy $E_0$ and its wavelength conversion value $\lambda_0$ ($=hc/E_0$, wherein c represents the speed of light) is the absorption end wavelength of photoabsorption spectrum.

In the present invention, the transmission factor of a surface layer can be measured for a surface layer detached from an image bearing member with a spectral photometer (UV3100, manufactured by Shimadzu Corporation) or another similar device. As a specific method of detaching a surface layer from an image bearing member, there is, for example, a method in which a surface layer and the layer on which the surface layer is provided are simultaneously detached followed by dissolving or abrading the layer on which the surface layer is provided.

Next, the radical polymerizable monomer for use in the present invention is described.

In the present invention, as the radical polymerizable monomer having a charge transport structure, there are compounds having a radical polymerizable functional group and a positive hole structure, for example, triaryl amine, hydrazone, pyrazoline, and carbazole, or an electron transport structure, for example, condensed polycyclic quinone, diphenoquinone and an electron absorbing aromatic ring having cyano group and a nitro group, etc. The radical polymerizable functional group has a carbon-carbon double bond (C=C) and can be radically polymerized.

Specific examples of the radical polymerizable functional groups include, but are note limited to, vinyl group based functional groups and 1-substituted vinyl group based functional groups.

The compounds represented by the following chemical structure: $CH_2=CH-X_1-$ can be used as the vinyl group based functional group.

In the chemical structure, $X_1$ represents an arylene group, for example, a substituted or non-substituted phenylene group or naphthylene group, a substituted or non-substituted alkenylene group, carbonyl group, —CO)—, —CON($R_{10}$) ($R_{10}$ represents hydrogen atom, an alkyl group, for example, methyl group or ethyl group, an aralkyl group, for example, benzyl group, naphthyl methyl group, and an aryl group, for example, phenethyl group or naphthyl group), or —S—).

Specific examples of these functional groups include, but are not limited to, vinyl group, styryl group, 2-methyl-1,3-butadienyl group, vinyl carbonyl group, acryloyloxy group, acryloyl amide group, and vinylthio group.

A specific example of a 1-substituted vinyl group based functional group is the functional group represented by the following chemical structure (i):

$$CH_2=C(Y)-(X_2)_d- \qquad \text{Chemical structure (i)}$$

wherein Y represents a substituted or non-substituted alkyl group, a substituted or non-substituted aralkyl group, an aryl group, for example, a substituted or non-substituted phenyl group or naphthyl group, a halogen atom, cyano group, nitro group, an alkoxy group, for example, methoxy group or ethoxy group, —$COOR_{11}$ ($R_{11}$ represents hydrogen atom, an alkyl group, for example, a substituted or non-substituted methyl group or ethyl group, an aralkyl group, for example, a substituted or non-substituted benzyl group or a substituted or non-substituted phenethyl group, an aryl group, for example, a substituted or non-substituted phenyl group or a substituted or non-substituted naphtyl group, or —$CONR_{12}R_{13}$ ($R_{12}$ and $R_{13}$ independently represent hydrogen atom, an alkyl group, for example, a substituted or non-substituted methyl group or a substituted or non-substituted ethyl group, an aralkyl group, for example, a substituted or non-substituted benzyl group, a substituted or non-substituted naphthyl methyl group, or a substituted or non-substituted phenethyl group, or an aryl group, for example, a substituted or non-substituted phenyl group or a substituted or non-substituted naphthyl group). $X_2$ represents the same functional group as $X_1$ in the chemical structure (i) illustrated above or an alkylene group and d represents 0 or 1. At least one of Y and $X_2$ is an oxycarbonyl group, cyano group, an alkenylene group or an aromatic ring.

Specific examples of these functional groups include, but are not limited to, α-cyanoacryloyloxy group, methacryloyloxy group, α-cyanovinyl group, α-cyanoacryloyloxy group, α-cyanovinylphenylene group and methacryloyl amino group.

Specific examples of the substitution groups further substituted to the substitution groups of $X_1$, $X_2$ and Y include, but are not limited to, halogen atom, nitro group, cyano group, an alkyl group, for example, methyl group or ethyl group, an alkoxy group, for example, methoxy group or ethoxy group, an aryloxy group, for example, phenoxy group, an aryl group, for example, phenyl group or naphthyl group, and an aralkyl group, for example, benzyl group or phenethyl group.

Among these radical polymerizable functional groups, an acryloyloxy group and a methacyloyloxy group are particularly suitable. In addition, a triarylamine structure is preferred as the charge transport structure.

In the present invention, as the radical polymerizable monomer having a charge transport structure, it is preferred to use at least one of the compounds represented by the following chemical structures 1 and 2. Thereby, the electric characteristics, for example, the sensitivity and the residual voltage, are preferably maintained.

Chemical structure 1

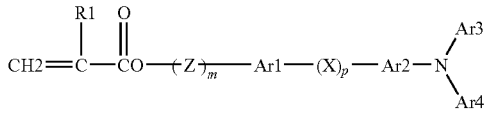

Chemical structure 2

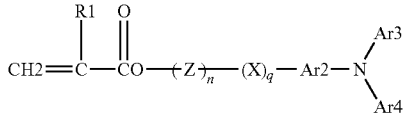

In the chemical structures 1 and 2, $R_1$ represents hydrogen atom, a halogen atom, an alkyl group, an aralkyl group, an aryl group, cyano group, nitro group, an alkoxy group, —$COOR_7$, wherein $R_7$ represents hydrogen atom, a substituted or non-substituted alkyl group, a substituted or non-substituted aralkyl group or a substituted or non-substituted aryl group, —COY (Y represents a halogen group) or $CONR_8R_9$, wherein $R_8$ and $R_9$ independently represent hydrogen atom, a halogen atom, a substituted or non-substituted alkyl group, a substituted or non-substituted aralkyl group or a substituted or non-substituted aryl group, $Ar_1$ and $Ar_2$ independently represent a substituted or non-substituted arylene group, $Ar_3$ and $Ar_4$ independently represent a substituted or non-substituted aryl group, X represents a substituted or non-substituted alkylene group, a substituted or non-substituted cycloalkylene group, a substituted or non-substituted oxyalkylene group, oxy group, thio group or a vinylene group, Z represents a substituted or non-substituted alkylene group, a substituted or non-substituted oxyalkylene group or a combinational functional group of an oxyalkylene group and a carbonyl group, p and q independently represent 0 or 1 and m and n independently represent an integer of from 0 to 3.

Specific examples of the structure represented by the chemical structures (1) and (2) are as follows.

In the chemical structures (1) and (2), the alkyl group of $R_1$ is, for example, methyl group, ethyl group, propyl group, or butyl group. The aryl group thereof is, for examples phenyl group or naphthyl group. The aralkyl group thereof is, for example, benzyl group, phenethyl group, or naphthyl methyl group. The alkoxy group thereof is, for example, methoxy group, ethoxy group or propoxy group. These can be substituted by a halogen atom, nitro group, cyano group, an alkyl group, for examples methyl group or ethyl group, an alkoxy group, for example, methoxy group or ethoxy group, an aryloxy group, for example, phenoxy group, an aryl group, for example, phenyl group or naphthyl group, and an aralkyl group, for example, benzyl group or phenethyl group.

Among these, hydrogen atom and methyl group are especially preferred.

$Ar_3$ and $Ar_4$ represent a substituted or non-substituted aryl group. Specific examples thereof include, but are not limited to, condensed polycyclic hydrocarbon groups, non-condensed ring hydrocarbon groups and heterocyclic groups.

The condensed polycyclic hydrocarbon group preferably forts a ring having 18 or less carbon atoms. Specific examples thereof include, but are not limited to, pentanyl group, indenyl group, naphthyl group, azulenyl group, heptalenyl group, biphenylenyl group, as-indacenyl group, s-indacenyl group, fluorenyl group, acenaphtylenyl group, pleiadenyl group, acenaphthenyl group, phenalenyl group, phenanthryl group, anthryl group, fluoranthenyl group, acephenantrirenyl group, aceantrirenyl group, triphenyl group, pyrenyl group, chrysenyl group, and naphthacenyl group.

Specific examples of the non-condensed ring hydrocarbon group include, but are not limited to, a single-valent group of monocyclic hydrocarbon compounds, for example, benzene, diphenyl ether, polyethylene diphenyl ether, diphenylthio ether or diphenylsulfone, a single-valent group of non-condensed polycyclic hydrocarbon compounds, for example, biphenyl, polyphenyl, diphenyl alkane, diphenyl alkene, diphenyl alkyne, triphenyl methane, distyryl benzene, 1,1-diphenyl cycloalkane, polyphenyl alkane or polyphenyl alkene or a single-valent group of ring aggregated hydrocarbon compounds, for example, 9,9-diphenyl fluorene.

Specific examples of the heterocyclic group include, but are not limited to, a single-valent group of, for example, carbazol, dibenzofuran, dibenzothiophene, oxadiazole, or thiadiazole.

The substituted or non-substituted aryl groups represented by $Ar_3$ and $Ar_4$ can have the following substitution groups.

(1) a halogen atom, cyano group, or nitro group;

(2) a straight chained or branch chained alkyl group having 1 to 12 carbon atoms, preferably 1 to 8 carbon atoms and more preferably 1 to 4 carbon atoms. These alkyl groups can have fluorine atom, hydroxyl group, cyano group, an alkoky group having 1 to 4 carbon atoms, phenyl group or a phenyl group substituted by a halogen atom, an alkyl group having 1 to 4 carbon atoms or an alkoxy group having 1 to 4 carbon atoms. Specific examples thereof include, but are not limited to, methyl group, ethyl group, n-butyl group, isopropyl group, t-butyl group, s-butyl group, n-propyl group, trifluoromethyl group, 2-hydroxy ethyl group, 2-ethoxyethyl group, 2-cyanoethyl group, 2-methoxyethyl group, benzyl group, 4-chlorobenzyl group, 4-methyl benzyl group or 4-phenyl benzyl group;

(3) an alkoxy group (—$OR_2$), wherein $R_2$ represents the alkyl group defined in (2). Specific examples thereof include, but are not limited to, methoxy group, ethoxy group, n-propoxy group, i-propoxy group, t-butoxy group, n-butoxy group, s-butoxy group, i-butoxy group, 2-hydroxy ethoxy group, benzyl oxy group and trifluoromethoxy group;

(4) an aryloxy group: As an aryl group, for example, phenyl group and naphthyl group can be included. These can contain an alkoxy group having 1 to 4 carbon atoms, an alkyl group having 1 to 4 carbon atoms or a halogen atom as a substitution group. Specific examples thereof include, but are not limited to, phenoxy group, 1-naphtyloxy group, 2-naphtyloxy group, 4-methoxyphenoxy group, or 4-methylphenoxy group;

(5) an alkyl mercapto group or an aryl mercapto group: Specific examples thereof include, but are not limited to, methylthio group, ethylthio group, phenylthio group, or p-methylphenylthio group;

(6) a group represented by $NR_3R_4$, wherein $R_3$ and $R_4$ independently represent hydrogen atom, the alkyl group defined in (2), or an aryl group. Specific examples of the aryl group include, but are not limited to, phenyl group, biphenyl group, or naphthyl group. These can contain an alkoxy group having 1 to 4 carbon atoms, an alkyl group having 1 to 4 carbon atoms or a halogen group. $R_3$ and $R_4$ can form a ring together. Specific examples thereof include, but are not limited to, amino group, diethyl amino group, N-methyl-N-phenyl amino group, diphenyl amino group, di(tolyl)amino group, dibenzyl amino group, piperidino group, morpholino group, or pyrrolidino group;

(7) an alkylene dioxy group or an alkylene dithio group, for example, methylene dioxy group or methylene dithio group; and (8) a substituted or non-substituted styryl group, a substituted or non-substituted β-phenyl styryl group, diphenyl aminophenyl group, ditolyl aminophenyl group, etc.

The arylene groups represented by $Ar_1$ and $Ar_2$ are divalent groups derived from the aryl group represented by $Ar_3$ and $Ar_4$.

Specific examples of the substituted or non-substituted alkylene group of X include, but are not limited to, a straight chained or branch chained alkylene group having 1 to 12 carbon atoms, preferably 1 to 8 carbon atoms and more preferably from 1 to 4 carbon atoms. These alkylene groups can further have fluorine atom, hydroxyl group, cyano group, an alkoxy group having 1 to 4 carbon atoms, phenyl group or a phenyl group substituted by a halogen atom, an alkyl group having 1 to 4 carbon atoms or an alkoxy group having 1 to 4 carbon atoms. Specific examples thereof include, but are not limited to, methylene group, ethylene group, n-butylene group, isopropylene group, t-butylene group, s-butylene group, n-propylene group, trifluoromethylene group, 2-hydroxy ethylene group, 2-ethoxyethylene group, 2-cyanoethylene group, 2-methoxyethylene group, benzylidene group, phenyl ethylene group, 4-chlorophenyl ethylene group, 4-methylphenyl ethylene group, or 4-biphenyl ethylene group.

Specific examples of the substituted or non-substituted cycloalkylene groups of X include, but are not limited to, cyclic alkylene group having 5 to 7 carbon atoms. These cyclic alkylene groups can have fluorine atom, a hydroxyl group, an alkyl group having 1 to 4 carbon atoms, or an alkoxy group having 1 to 4 carbon atoms. Specific examples thereof include, but are not limited to, cyclohexylidene group, cyclohexylene group, or 3,3-dimethyl cyclohexylidene group.

Specific examples of the substituted or non-substituted oxyalkylene group include, but are not limited to, oxyalkylene groups, for example, ethyleneoxy group or propyleneoxy group, alkylene dioxy groups derived from ethylene glycol or propylene glycol, and di(oxyalkylene)oxy or poly (oxyalkylene) groups derived from diethylene glycol, tetraethylene glycol, tripropylene glycol, etc. Alkylene groups of the oxyalkylene groups can have a substitution group, for example, hydroxyl group, methyl group, or ethyl group.

The vinylene groups represented by X are, for example, substitution groups represented by the following chemical structure 3 or 4:

[Chemical structure 3]

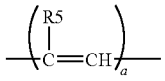

[Chemical structure 4]

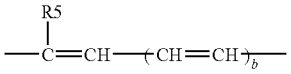

In the chemical structures 3 and 4, $R_5$ represents hydrogen atom, an alkyl group (the same as the alkyl groups defined in (2)), an aryl group (the same as the aryl groups of $Ar_3$ and $Ar_4$ mentioned above), a represents 1 or 2 and b represents an integer of from 1 to 3.

Specific examples of the alkylene group and oxyalkylene group include the same as those mentioned for X. Caprolactone modified groups are suitable as the combinational functional groups of the oxyalkylene group and the carbonyl group.

In the present invention, the radical polymerizable compound having a charge transport structure is more preferably the compound represented by the following chemical structure 5:

[Chemical structure 5]

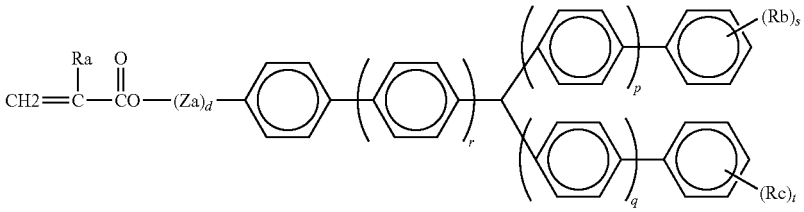

In the chemical structure 5, d, r, p q independently represent 0 or 1. s and t independently represent an integer of from 0 to 3. Ra represents hydrogen atom or methyl group Each of Rb and Rc independently represent an alkyl group having 1 to 6 carbon atoms. Za represents methylene group, ethylene group, $—CH_2CH_2O—$, $—CHCH_3CH_2O—$, or $—C_6H_5CH_2CH_2$.

Among the compounds represented by the chemical structure 5 illustrated above, the compounds in which Rb and Rc independently represent a methyl group or an ethyl group are particularly preferred.

In the present invention, the radical polymerizable compound with a charge transport structure is preferred to be a compound represented by the following chemical structure 6:

$B_1—Ar_5—CH=CH—Ar_6—B_2$. [Chemical Structure 6]

In the chemical structure 6, $Ar_5$ represents a univalent or divalent substituted or non-substituted aromatic hydrocarbon. Specific examples of the aromatic hydrocarbon base (unsubstituted) include, but are not limited to, benzene, naphthalene, phenanthrene, biphenyl and 1,2,3,4-tetrahydronaphthalene.

Specific examples of the substitution group include, but are not limited to, an alkyl group having 1 to 12 carbon atoms, an alkoxy group having 1 to 12 carbon atoms, benzyl group, or a halogen group. In addition, the alkyl group can be substituted by a halogen group or phenyl group.

$Ar_6$ represents a divalent aromatic hydrocarbon having at least one tertiary amino group, or a univalent or divalent heterocyclic compound at least having at least one tertiary amino group. The aromatic hydrocarbon having at least one tertiary amino group is represented by the following chemical structure 7.

[Chemical structure 7]

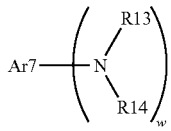

In the chemical structure 7, $R_{13}$ and $R_{14}$ independently represent an acyl group, a substituted or non-substituted alkyl group, or a substituted or non-substituted aryl group. $Ar_7$ represents an aryl group and w represents an integer of from 1 to 3.

Specific examples of the acryl group of $R_{13}$ and $R_{14}$ include, but are not limited to, acetyl group, propionyl group or benzoyl group. Specific examples of the substituted or non-substituted alkyl group of $R_{13}$ and $R_{14}$ are the same as those mentioned for the substitution group of $Ar_5$. Specific examples of the substituted or non-substituted aryl group of $R_{13}$ and $R_{14}$ include, but are not limited to, phenyl group, naphthyl group, biphenyl group, terphenylyl group, pyrenyl group, fluorenyl group, 9,9-dimethyl-2-fluorenyl group, azulenyl group, anthryl group, triphenylenyl group, chrysenyl group or a functional group represented by the following chemical structure 8:

[Chemical structure 8]

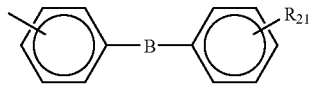

In the chemical structure 8, B represents oxy group, thio group, sulphinyl group, sulfonyl group, carbonyl group, the group represented by the chemical structure 9 or chemical structure 10,

[Chemical structure 9]

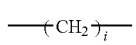

[Chemical structure 10]

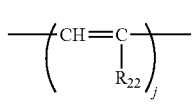

wherein $R_{22}$ represents hydrogen atom, the substituted or non-substituted alkyl group defined for $Ar_5$, or the substituted or non-substituted aryl group defined for $R_{13}$, i represents an integer of from 1 to 12, j represents an integer of from 1 to 3, $R_{21}$ represents hydrogen atom, the substituted or non-substituted alkyl group defined for $Ar_5$, an alkoxy group, a halogen group, the substituted or non-substituted aryl group defined for $R_{13}$, an amino group, nitro group, or cyano group.

Specific examples of the alkoxy group for $R_{21}$ include, but are not limited to, methoxy group, ethoxy group, n-propoxy group, isopropoxy group, n-butoxy group, isobutoxy group, s-butoxy group, t-butoxy group, 2-hydroxyethoxy group, 2-cyanoethoxy group, benzyloxy group, 4-methyl benzyloxy group or trifluoromethoxy group. Specific examples of the halogen group for $R_{21}$ include fluoro group, chloro group, bromo group and iodine group. Specific examples of the amino group for $R_{21}$ include, but are not limited to, diphenylamino group, ditolylamino group, dibenzyl amino group or 4-methylbenzyl group.

Specific examples of the aryl group for $Ar_7$ include, but are not limited to, phenyl group, naphthyl group, biphenyl group, terphenylyl group, pyrenyl group, fluorenyl group, 9,9-dimethyl-2-fluorenyl group, azulenyl group, anthryl group, triphenylenyl group or chrysenyl group.

$Ar_7$, $R_{13}$ and $R_{14}$ can be substituted by an alkyl group, an alkoxy group or a halogen group defined for $Ar_5$.

Specific examples of the heterocyclic compounds having a tertiary amino group include, but are not limited to, amino structured heterocyclic compounds, for example, pyrrole, pyrazole, imidazole, triazole, dioxazole, indole, isoindole, benzimidazole, benzotriazole, benzoisoxadine, carbazole or phenoxadine.

$B_1$ and $B_2$ represent an acryloyloxy group, a methacryloyloxy group, vinyl group or an alkyl group or an alkoxy group having an acryloyloxy group, a methacryloyloxy group, or a vinyl group. Specific examples of the alkyl group and the alkoxy group include those defined for $Ar_5$. Only either of $B_1$ and $B_2$ is present and both thereof are not present simultaneously.

In the present invention, the radical polymerizable monomer having a charge transport structure is further preferably the compound represented by the following chemical structure 11:

[Chemical structure 11]

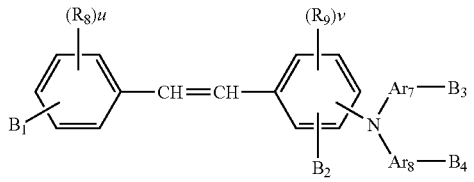

In the chemical structure 11, $R_8$ and $R_9$ independently represent hydrogen atom, a substituted or non-substituted alkyl group, a substituted or non-substituted alkoxy group or a halogen group. $Ar_6$ and $Ar_7$ independently represent a substituted or non-substituted aryl group, an arylene group, or a substituted or non-substituted benzyl group or a halogen group.

The alkyl group, the alkoxy group and the halogen group of $R_8$ and $R_9$ are those defined for $Ar_5$. The aryl group of $Ar_7$ and $Ar_8$ is one of those defined for $R_{13}$ and $R_{14}$ and the arylene group is a divalent group derived from the aryl group.

$B_1$ to $B_4$ are those for $B_1$ and $B_2$ in the chemical structure 6. Only one of $B_1$ to $B_4$ is present and two or more of them are not present simultaneously. u and v represent an integer of from 0 to 5 and an integer of from 0 to 4, respectively.

The compound represented by the chemical structure 6 or 11 is a tertiary amine compound having a stilbene type conjugate structure. By using a charge transport material having such a conjugate structure, the charge infusion property at the interface to a surface layer is significantly improved. Further, when the charge transport material is fixed between cross linking linkages, the intermolecular function is hardly inhibited so that the charge transport property is good. In addition, the charge transport material contains an acryloyloxy group or a methacryloxy group having a high radical polymerizable property in a molecule so that gelatification is rapidly conducted during radical polymerization and excessive cross linking distortion can be prevented. Furthermore, the double linkage in the stilbene structure is partially polymerized but the degree of the polymerization is relatively low in comparison with that of the acryloyloxy group or the methacryloyloxy group. Therefore, there is a time lag in the curing reaction, by which the distortion can be restrained. Furthermore, since the double linkage in a molecule is used, the cross linking density can be improved and the anti-abrasion property can be further improved. This double linkage can be controlled by the curing condition with regard to the degree of the polymerization so that an optimally cured layer can be easily formed. Such radical polymerization does not occur in the α-phenylstilbene type structure mentioned above.

As described above, by using the compound represented by the chemical structure 6 and especially the chemical structure 11, it is possible to form a layer having a high cross linking density thereby preventing the occurrence of cracking in addition to maintaining good electric characteristics. Consequently, while satisfying various kinds of characteristics of an image bearing member, it is possible to restrain silica particulates, etc., from sticking to the image bearing member and reduce the image deficiency, for example, white spots.

The compound represented by the chemical structures 2, 5, 6 or 11 and especially 5 and 11 is present in the main chain or a cross linking chain between the main chains in a cured resin obtained by copolymerizing with a radical polymerizable monomer having at least 3 functional groups. There are two kinds of cross linking chains. One is referred to as intermolecule cross-linking in which the cross linking chain is formed between a polymer and another polymer. The other is referred to as internal cross linking in which the cross linking chain is formed between a portion and another portion in the main chain present in a polymer in a folded state. Whether the compound mentioned above is present in a main chain or in a cross-linking chain, the triaryl amine structure suspending from the chain portion has at least three aryl groups disposed in the radial directions from the nitrogen atom therein. Such a triaryl amine structure is bulky and does not directly bind with the chain portion but suspends from the chain portion via carbonyl group, etc. That is, the triaryl amine structure is stereoscopically fixed in a flexible state. Therefore, these triaryl amine structures can be adjacent to each other with a moderate space in a cured resin. Therefore, the structural distortion in a molecule is slight. In addition, when the structure is used in the cross linking charge transport layer of an image bearing member, it can be deduced that the internal molecular structure is formed in the surface layer while having a structure in which there are relatively few disconnections in the charge transport route.

Below are specific examples of the radical polymerizable compound having a triaryl amine structure as the charge transport structure. But the radical polymerizable compounds are not limited thereto and a radical polymerizable monomer having two functional groups can be also used.

No.1
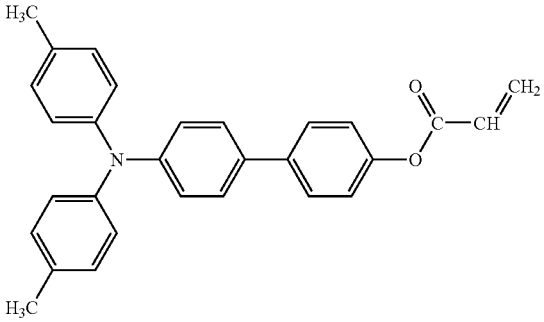
No.2
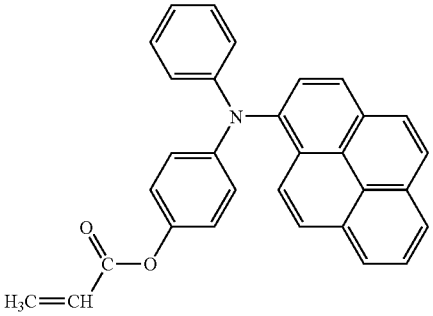
No.3
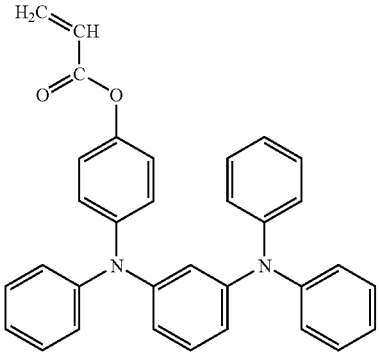
No.4
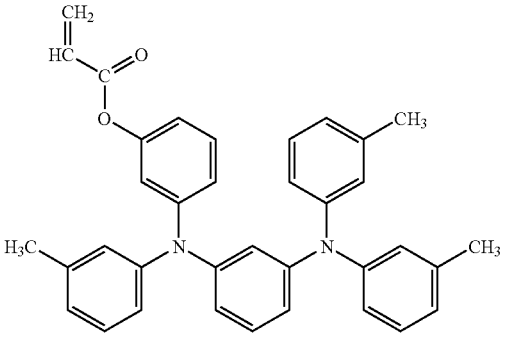
No.5
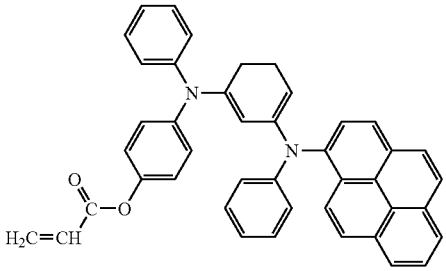
No.6
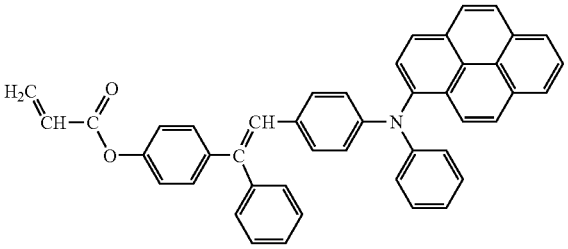
No.7
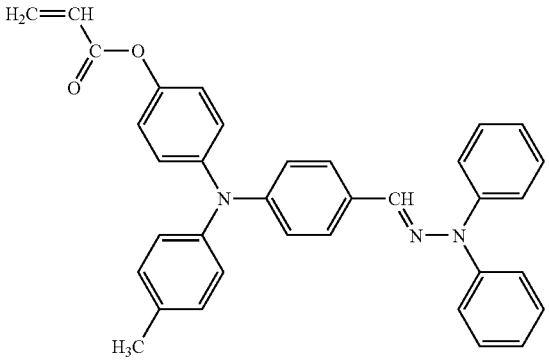
No.8
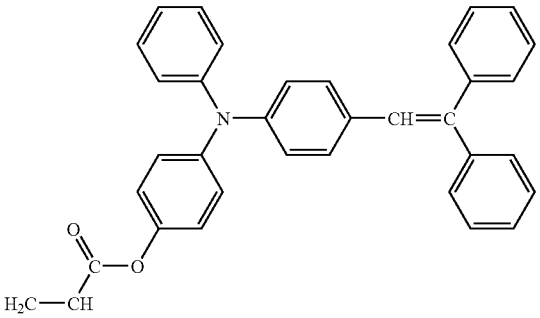
No.9
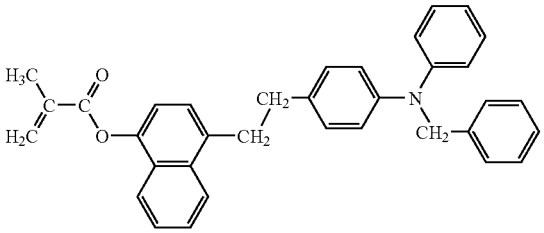
No.10
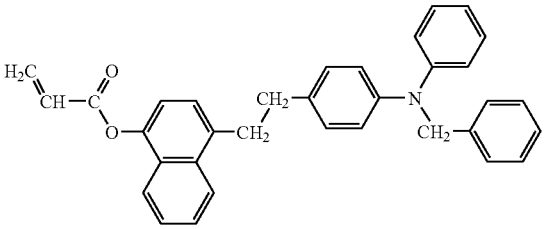

-continued
No.11
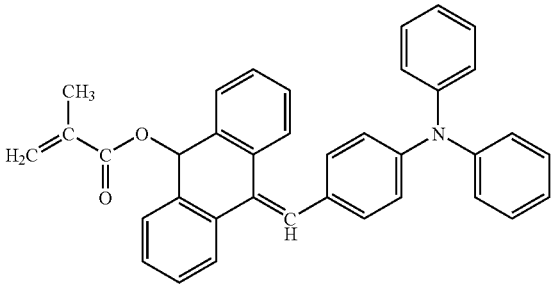
No.12
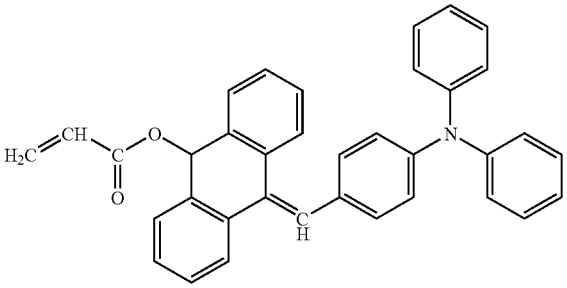
No.13
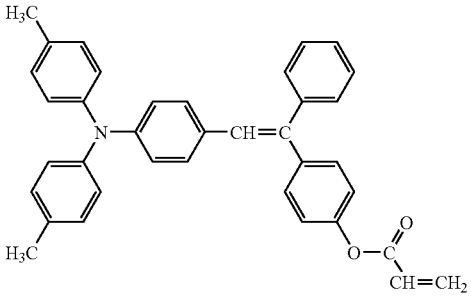
No.14
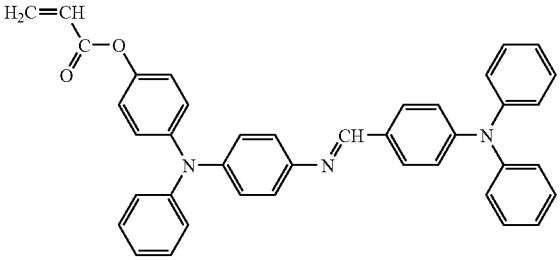
No.15
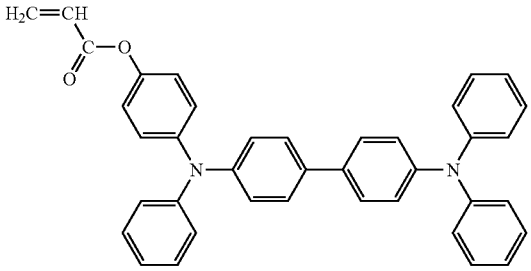
No.16
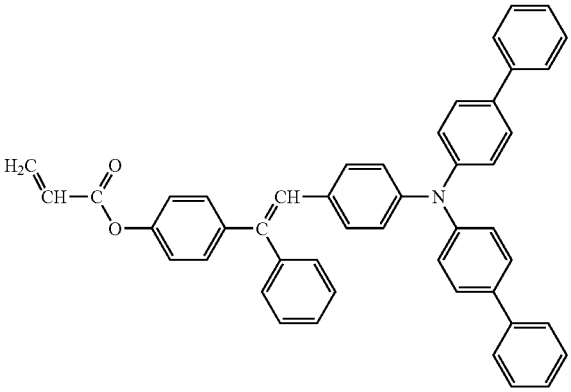
No.17
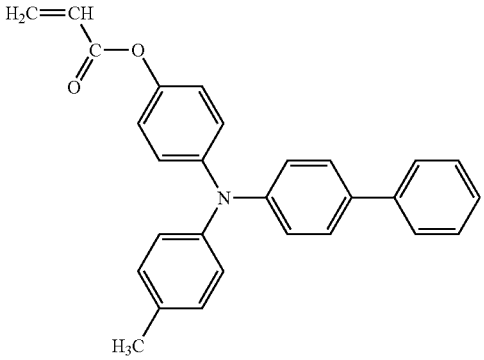
No.18
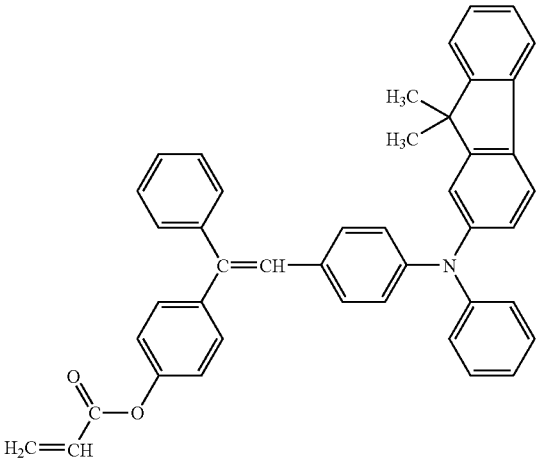

-continued
No.19
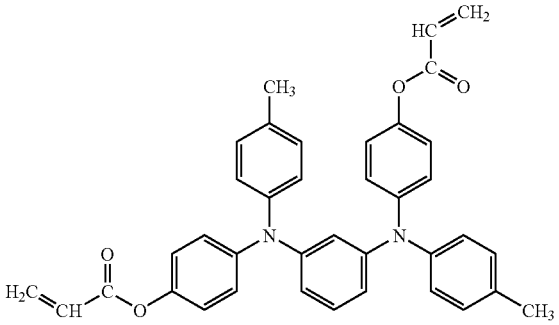
No.20
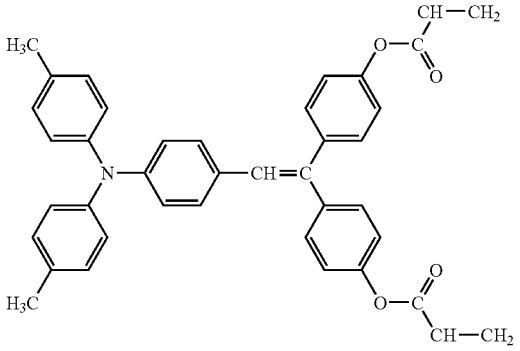
No.21
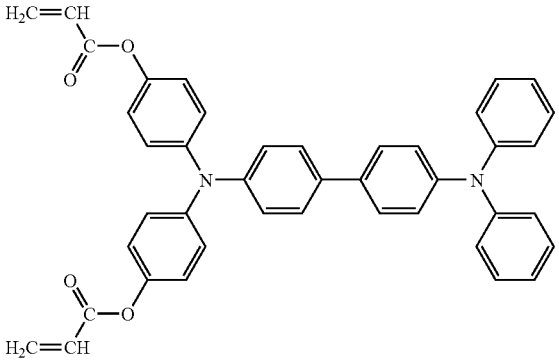
No.22
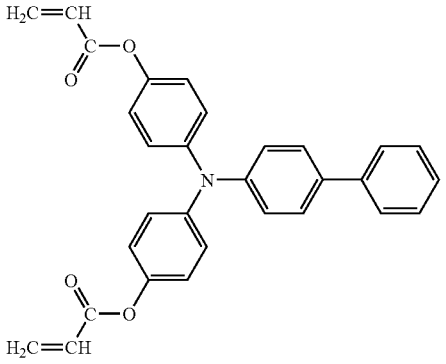
No.23
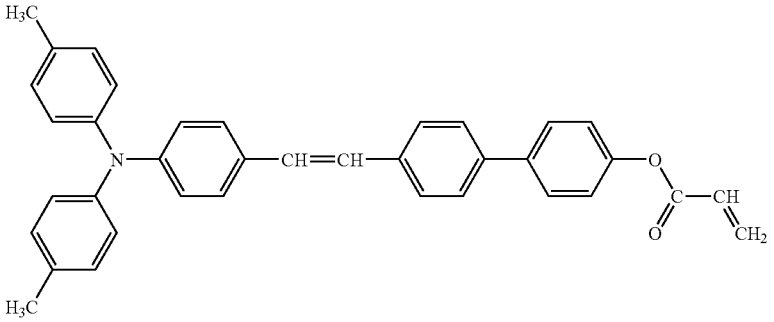
No.24
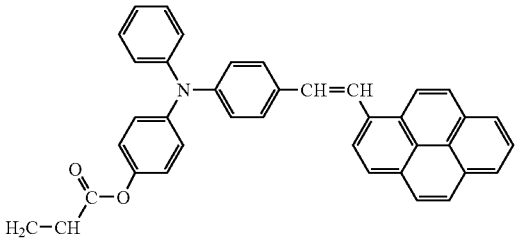
No.25
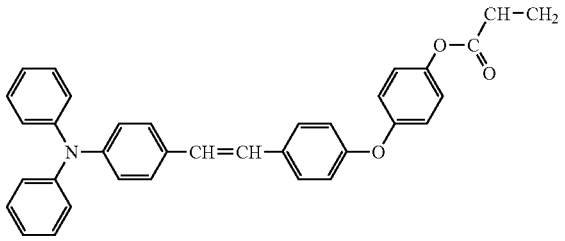

-continued
No.26
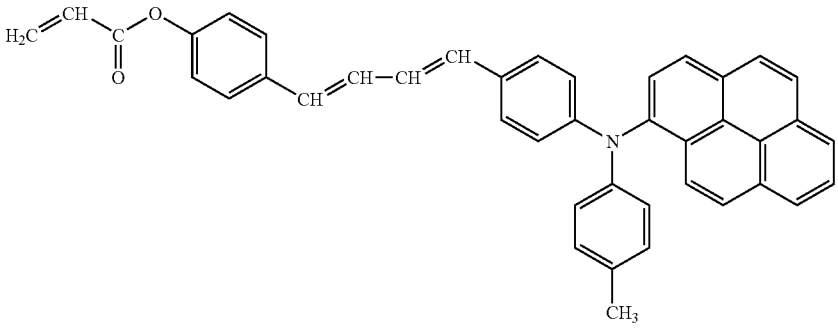
No.27
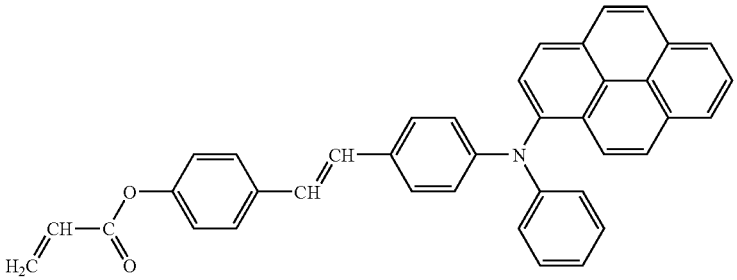
No.28
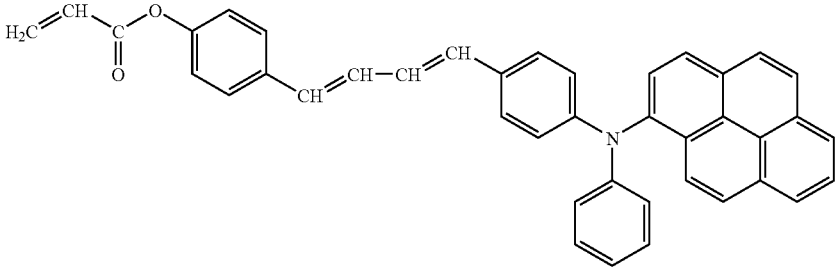
No.29
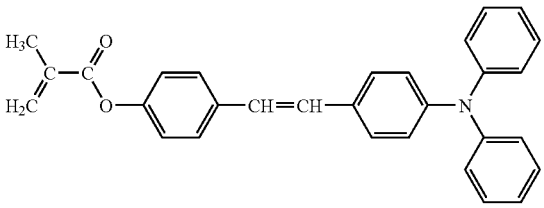
No.30
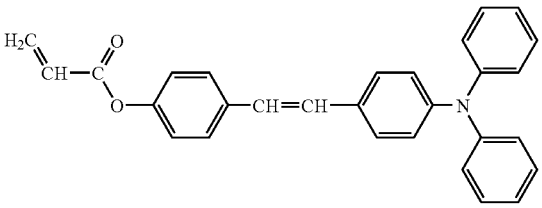
No.31
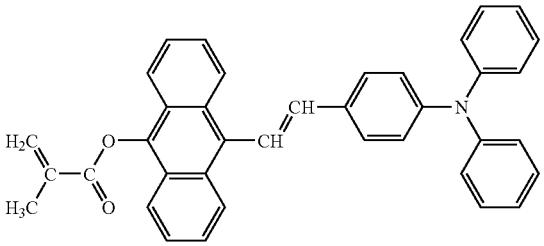
No.32
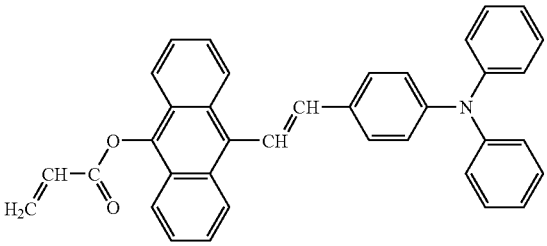

-continued
No.33
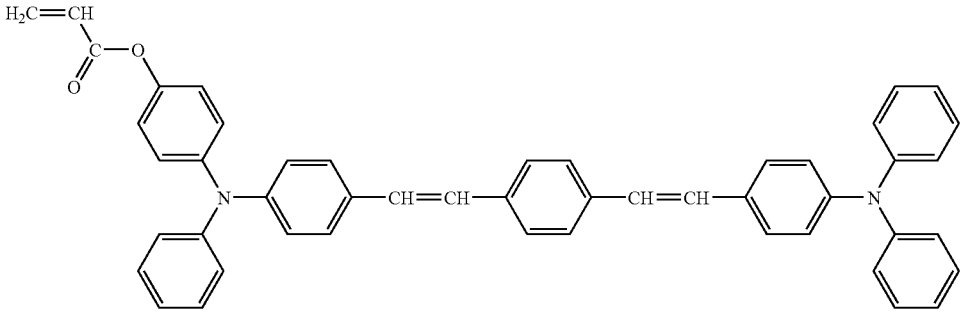
No.34
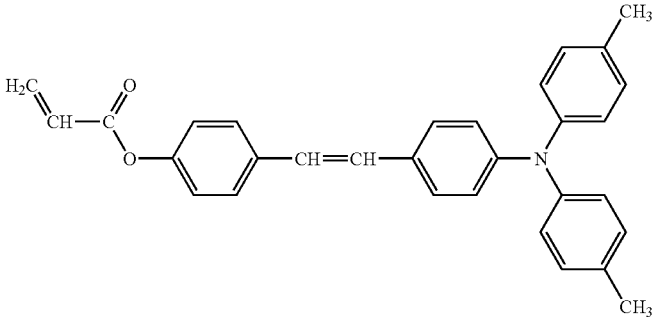
No.35
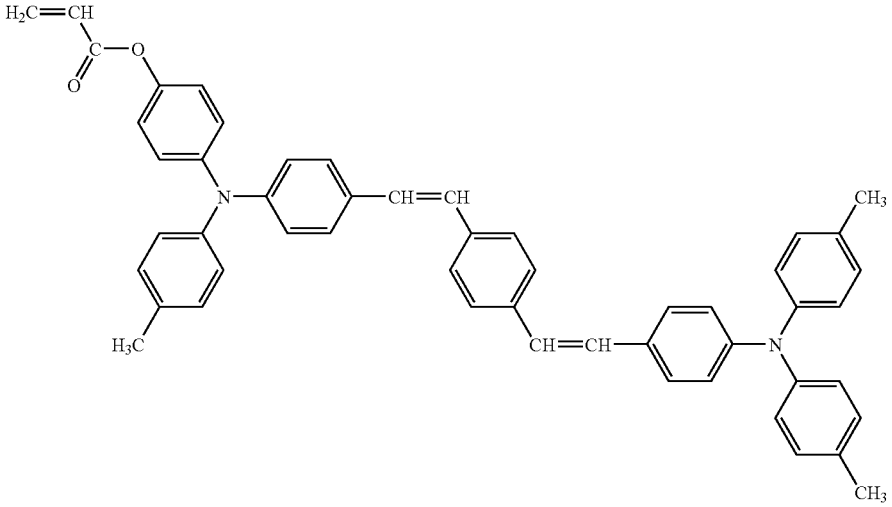
No.36
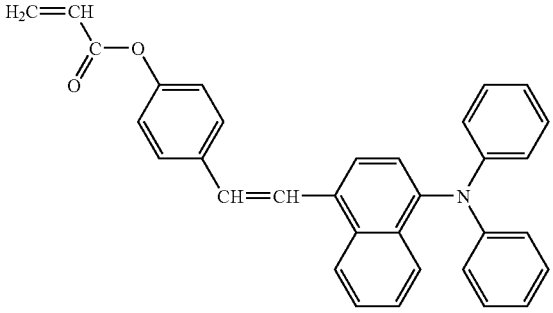

-continued
No.37
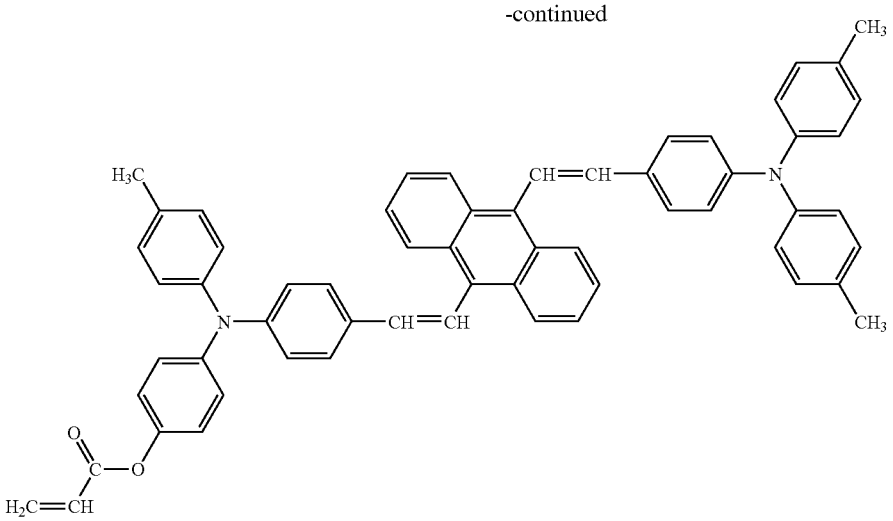
No.38
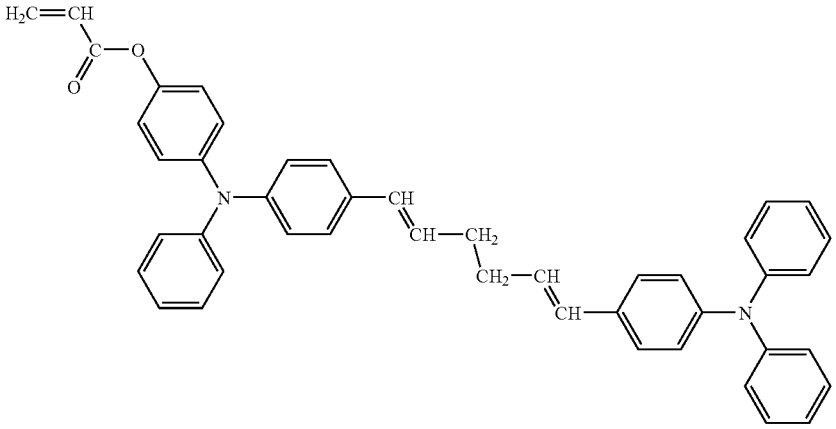
No.39
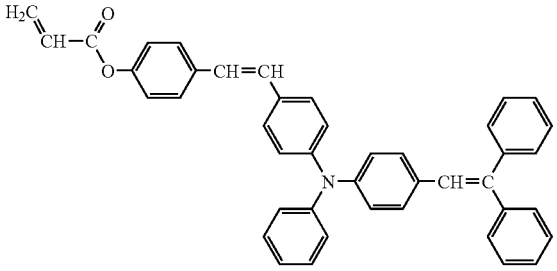
No.40
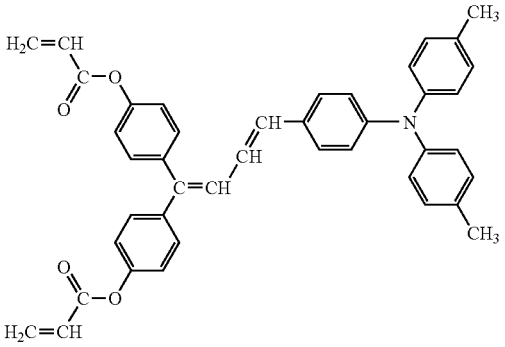
No.41
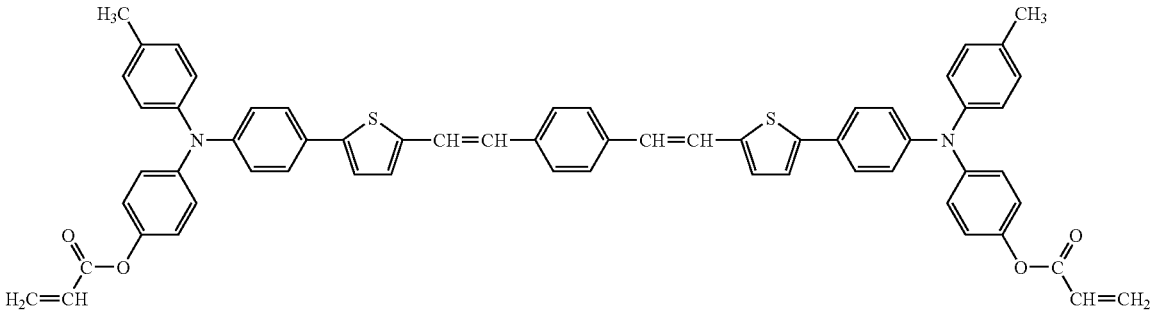

-continued
No.42
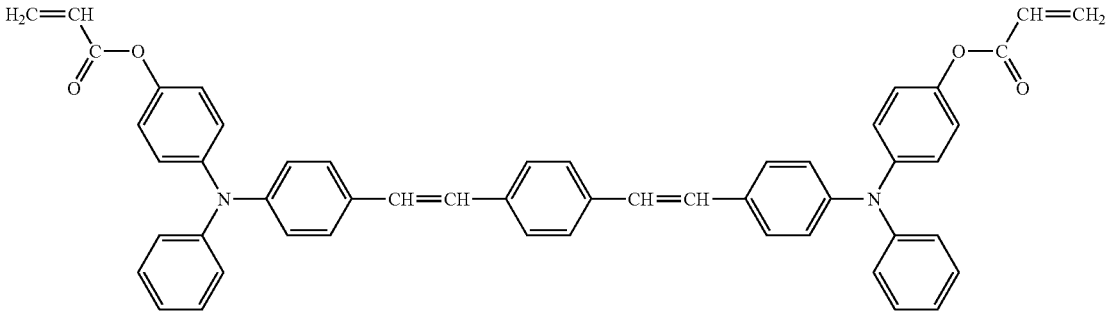
No.43
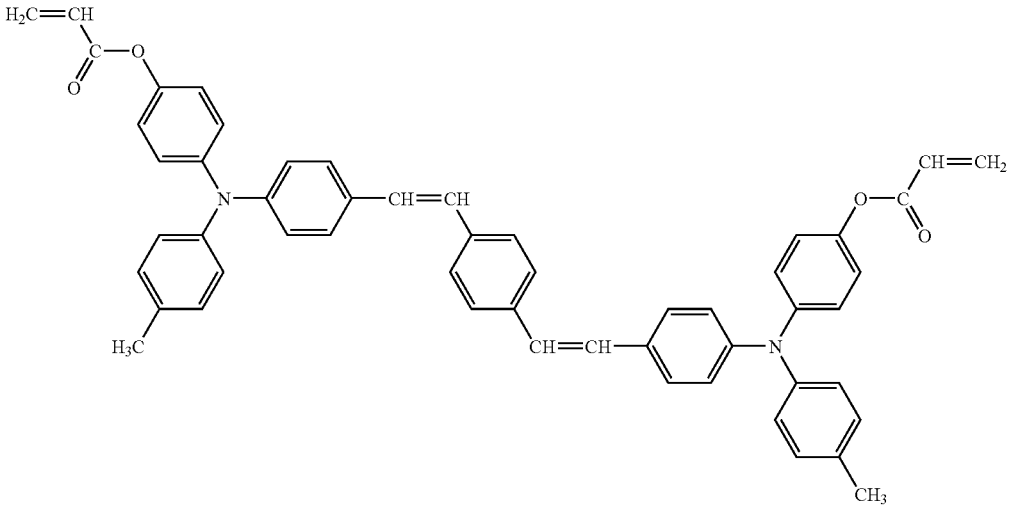
No.44
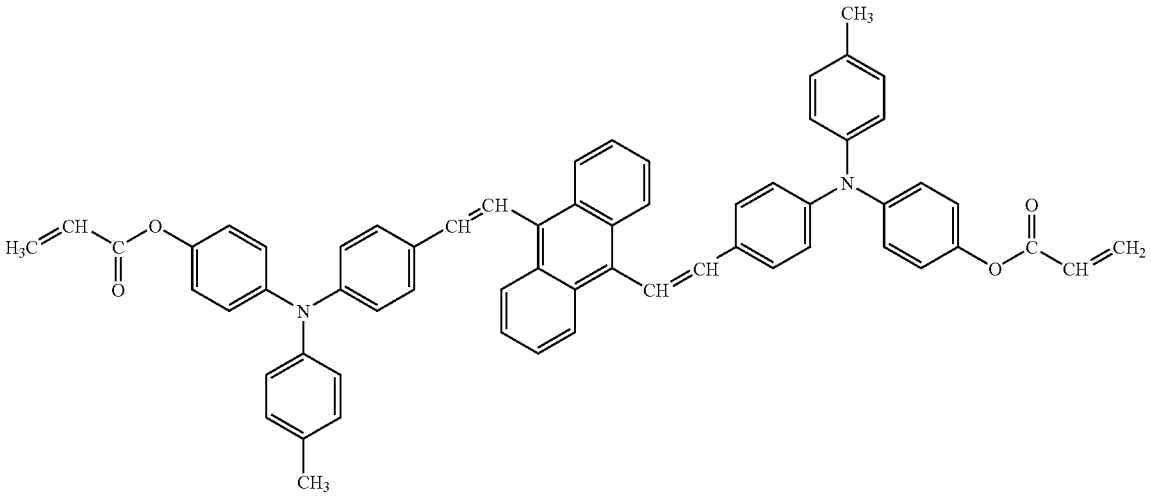

-continued

No.45

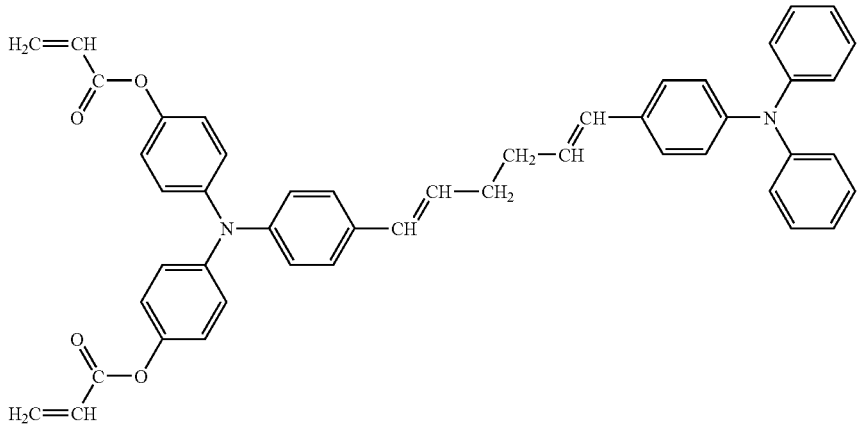

No.46

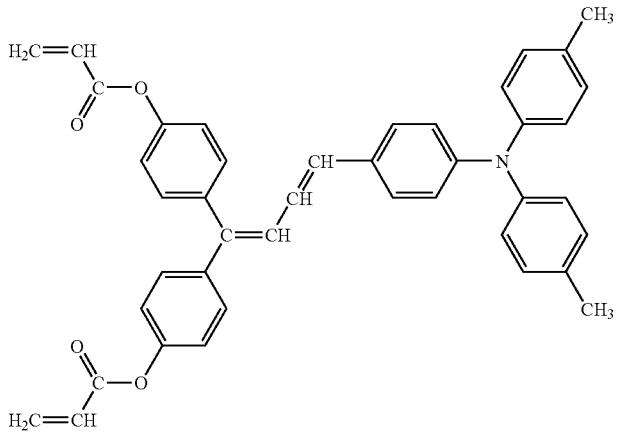

In the present invention, the radical polymerizable compound having a charge transport structure imparts a charge transport function to the surface layer. The content of the surface layer is from 20 to 80% by weight, and preferably from 30 to 70% by weight. When the content is too small, the charge transport function of the surface layer is not maintained, which may lead to deterioration of the electric characteristics, for example, a decrease in the sensitivity and a rise in the residual voltage, during repetitive use. When the content is too large, the content of the radical polymerizable monomer without a charge transport structure decreases. That is, the cross linking density decreases, resulting in the shortage of the anti-abrasion property. Desired electric characteristics and anti-abrasion property vary depending on the process. Therefore, it is difficult to jump to any conclusion but considering the balance of both characteristics and property, the addition amount is most preferably from 30 to 70% by weight.

In the present invention, as the radical polymerizable functional group of the radical polymerizable monomer which does not have a charge transport structure, the same groups as those for the radical polymerizable monomer having a charge transport structure can be used. Among them, an acryloyloxy group and a methacryloyloxy group are preferred. In terms of the anti-abrasion property, the radical polymerizable monomer which does not have a charge transport structure preferably has at least 3 functional groups. The radical polymerizable functional groups of the radical polymerizable monomer having at least three functional groups which does not have a charge transport structure can be the same or different from each other.

The acryloyloxy group having at least 3 acryloyloxy groups can be prepared by an esterification reaction or an ester exchange reaction between a compound having at least 3 hydroxyl groups and acrylic acid (salt), a halogenated acrylate or an ester of acrylic acid. The methacryloyloxy group having at least 3 methacryloyloxy groups can be prepared in the same manner.

Specific examples of the radical polymerizable monomer having at least three functional groups without having a charge transport structure include, but are not limited to, trimethylol propane triacrylate (TMPTA), trimethylol propane trimethacrylate, hydroxy propyl acrylate (HPA) modified trimethylol propane triacrylate, ethyleneoxy (EO) modified trimethylol propane triacrylate, propyleneoxy (PO) modified trimethylol propane triacrylate, caprolactone modified trimethylol propane triacrylate, hydroxy propyl acrylate (HPA) modified trimethylol propane triacrylate, pentaerythritol triacrylate, pentaerythritol tetra acrylate (PETTA), glycerol triacrylate, epichlorohydrin (ECH) modified glycerol triacrylate, ethyleneoxy (EO) modified glycerol triacrylate, propyleneoxy (PO) modified glycerol triacrylate, tris(acryloxyethyl)isocyanulate, dipenta erythritol hexaacrylate (DPHA), caprolactone modified dipenta erythritol hexaacrylate, dipenta erythritol hydroxy pentaacrylate, alkyl modified dipenta erythritol pentaacrylate, alkyl modified dipenta erythritol tetraacrylate, alkyl modified dipenta erythritol triacrylate, dimethylol propane hexaacrylate (DTMPTA), penta erythritol ethoxy tetraacrylate, ethyleneoxy (EO) modified phosphoric acid triacrylate, and 2,2,5,5-tetrahydroxy methyl cyclopentanone hexaacrylate. These can be used alone or in combination.

In addition, the radical polymerizable monomer without having a charge transport structure preferably has a ratio (molecular weight/the number of functional groups) of molecular weight to the number of functional groups in the monomer that is not greater than 250 to form a dense cross linking structure in a surface layer. When the ratio (molecular weight/number of functional groups) is too large, the surface layer is soft, which may result in deterioration of the anti-abrasion property. Therefore, among the monomers mentioned above, it is not preferred to singly use a monomer having a modified functional group, for example, HPA, EO and PO, when the modified functional group is extremely long.

In addition, the content of the radical polymerizable monomer without having a charge transport structure is from 20 to 80% by weight and preferably from 30 to 70% by weight based on the total weight of a surface layer. When the addition amount is too small, the density of cross linking in the surface layer tends to be small, which may degrade the anti-abrasion characteristic thereof. When the content is too large, the content of a radical polymerizable monomer having a charge transport structure decreases, which may result in deterioration of the electric characteristics. Desired electric characteristics and anti-abrasion property vary depending on the process. Therefore, it is difficult to jump to any conclusion, but considering the balance of both characteristics, the addition amount is preferably from 30 to 70% by weight.

In the present invention, a liquid to be applied to form a surface layer on the substrate can contain a radical polymerizable monomer having one or two functional groups which does not have a charge transport structure, a functional monomer which does not have a charge transport structure and a radical polymerizable oligomer which does not have a charge transport structure can be used to adjust the viscosity upon coating, relax the stress, decrease the surface energy, reduce the friction index, etc. Known monomers and oligomers can be used.

Specific examples of the radical polymerizable monomer having one functional group which does not have a charge transport structure include, but are not limited to, 2-ethylhexyl acrylate, 2-hydroxyethyl acrylate, 2-hydroxypropyl acrylate, tetrahydrofurfuryl acrylate, 2-ethylhexyl carbitol acrylate, 3-methoxybutyl acrylate, benzyl acrylate, cyclohexyl acrylate, isoamyl acrylate, isobutyl acrylate, methoxy triethylene glycol acrylate, phenoxytetraethylene glycol acrylate, cetyl acrylate, isostearyl acrylate, stearyl acrylate and styrene.

Specific examples of the radical polymerizable monomer having two functional groups which does not have a charge transport structure include, but are not limited to, 1,3-butandiol diacrylate, 1,4-butane diol diacrylate, 1,4-butane diol dimethacrylate, 1,6-hexane diol diacrylate, 1,6-hexane diol dimethacrylate, diethylene glycol diacrylate, neopentyl glycol diacrylate, bisphenol A EO modified diacrylate, bisphenol F EO modified diacrylate and neopentyl glycol diacrylate.

Specific examples of the functional monomer which does not have a charge transport structure include, but are not limited to, a fluoro group substituted monomer, for example, octafluoro pentyl acrylate, 2-perfluorooctylethyl acrylate, 2-perfluorooctylethyl methacrylate and 2-perfluoroisononyl-ethyl acrylate and vinyl monomers, acrylates and methacrylates having polysiloxane groups, for example, acryloyl polydimethyl siloxane ethyl, methacryloyl polydimethyl siloxane ethyl, acryloyl polydimethyl siloxane propyl, acryloyl polydimethyl siloxane butyl and diacryloyl polydimethyl siloxane diethyl having 20 to 70 siloxane repeating units set forth in JPPs H05-60503 and H06-45770.

Specific examples of the radical polymerizable oligomer without a charge transport structure include, but are not limited to, epoxyacrylate based, urethane acrylate based, and polyester acrylate based oligomers.

When a radical polymerizable monomer and/or oligomer having one or two functional groups which does not have a charge transport structure are contained in a large amount, the cross linking density of the surface layer substantially decreases, which invites the deterioration of the anti-abrasion property. Therefore, the content of these monomers and oligomers is not greater than 50 parts by weight and preferably not greater than 30 parts by weight based on 100 parts by weight of a radical polymerizable monomer having at least three functional groups which does not have a charge transport structure.

In the present invention when a surface layer is formed, a polymerization initiator can be added if desired to effectively conduct a curing reaction.

Specific examples of the photo polymerization initiators includes, but are not limited to, acetophenone based or ketal based photo polymerization initiators, for example, diethoxy acetopenone, 2,2-dimethoxy-1,2-diphenylethane-1-one, 1-hydroxy cyclohexyl phenylketone, 2-benzyl-2-dimethylamino-1-(4-morpholinophenyl)butanone-1,2-hydroxy-2-methyl-1-phenyl propane-1-one, 2-methyl-2-morpholino(4-methylthiophenyl)propane-1-one, and 1-phenyl-1,2-propane dione-2-(o-ethoxycarbonyl)oxime; benzoin ether based photo polymerization initiators, for example, benzoin, benzoin methyl ether, benzoin ethyl ether, benzoin isobutyl ether and benzoin isopropyl ether; benzophenone based photo polymerization initiators, for example, benzophenone, 4-hydroxy benzophenone, o-benzoyl benzoic acid methyl, 2-benzoyl naphthalene, 4-benzoyl biphenyl, 4-benzoyl phenyl ether, acrylated benzophenone and 1,4-benzoyl benzene; and thioxanthone based photo polymerization initiators, for example, 2-isopropyl thioxanthone, 2-chloro thioxanthone, 2,4-dimethyl thioxanthone, 2,4-diethyl thioxanthone, and 2,4-dichloro thioxanthone.

Other photo polymerization initiators are, for example, ethylanthraquinone, 2,4,6-trimethyl benzoyl diphenyl phosphine oxide, 2,4,6-trimethyl benzoyl phenyl ethoxy phosphine oxide, bis(2,4,6-trimethyl benzoyl)phenyl phosphine oxide, bis(2,4-dimethoxy benzoyl)-2,4,4-trimethyl pentyl phosphine oxide, methylphenyl glyoxy esters, 9,10-phenanthrene, acridine based compounds, triazine based compounds, and imidazole based compounds. In addition, compounds having photo polymerization promotion effect can be used alone or in combination with the photo polymerization initiators. Specific examples thereof include, but are not limited to, triethanol amine, methyldiethanol amine, 4-dimethylamino ethyl benzoate, 4-dimethylamino isoamyl benzoate, benzoic acid (2-dimethylamino)ethyl, and 4,4'-dimethylamino benzophenone.

These polymerization initiators can be used alone or in combination. The content of the polymerization initiator is from 0.5 to 40 parts of weight and preferably from 1 to 20 parts by weight based on 100 parts by weight of the total weight of the radical polymerizable compound.

Furthermore, a liquid of application for a surface layer can contain additives, for example, various kinds of plasticizing agents (to relax stress and improve adhesibility), and a leveling agent, if desired. Known additives can be used.

Specific examples of the plasticizing agent include, but are not limited to, compounds, for example, dibutyl phthalate and dioctyl phthalate, which are used for typical resins. The addition amount of the plasticizing agent is not greater than 20% by weight and more preferably not greater than 10% by weight based on all the solid portions of the liquid for preparing a surface layer.

In addition, specific examples of the leveling agent include, but are not limited to, silicone oils, for example, dimethyl silicone oil and methylphenyl silicone oil and polymers or oligomers having a perfluoroalkyl group in its branch chain. The addition amount of the leveling agent is not greater than 3% by weight based on all the solid portion of a liquid of application for a surface layer.

When a solvent for use in a liquid for preparing the surface layer has a slow evaporation speed, the solvent may remain, which leads to inhibition of the curing reaction and increase in the amount of commingling of the component of the layer under the surface layer. Consequently, the curing may not be uniformly conducted or the curing density may be lowered, resulting in the weakening of the chemical resistance. Therefore, tetrahydrofuran, a mixture solvent of tetrahydrofuran and methanol, ethylacetate, methylethyl ketone and ethyl cellosolve are preferred as the solvent. Such solvents can be suitably determined according to the coating method.

In addition, the density of the solid portion of a liquid for preparing the surface layer is preferably from 10 to 50% by weight. When the density of the solid portion is too low, the chemical resistance may deteriorate. In addition, due to the restriction on the layer thickness and the viscosity, the density of the solid portion is preferably not greater than 50% by weight.

In a method of coating a surface layer, it is preferred that the content of a solvent and the time of contacting the solvent during the formation of the surface layer are small and short. Specific examples thereof include, but are not limited to, a spray coating method, and a ring coating method in which the amount of application is restricted. To restrain the commingling of the component from the layer provided under a surface layer, it is effective to use a charge transport polymer in a photosensitive layer and to provide an intermediate layer insoluble in a solvent for use in the liquid forming the surface layer on a photosensitive layer.

In the present invention, as the light source for irradiation of light after the application of the liquid on a substrate, a high pressure mercury lamp having a luminescence wavelength mainly in the UV area, and UV irradiation light source, for example, a metal halide lamp, can be used. An optical wavelength light source can be selected depending on the absorption wavelength of a radical polymerizable monomer and an optical polymerization initiator. The amount of irradiation is not less than 50 $mW/cm^2$, preferably not less than 500 $mW/cm^2$ and more preferably not less than 1,000 $mW/cm^2$. Thereby, the curing reaction speed increases and a surface layer having a high uniformity can be obtained. Furthermore, by separating a light source room from an irradiation room by an optically transparent member, the light source can be prevented from contamination caused by volatile materials mainly generated during irradiation of light from the solvent and/or the radical polymerizable monomer contained in the liquid for preparing the surface layer. Therefore, it is possible to manufacture an image bearing member which is stable and excellent for an extended period of time.

In addition, by separating a light source room from an irradiation room by an optically transparent member, it is possible to control the atmosphere in the irradiation room. The atmosphere in the irradiation room can be air, an inert gas or vacuum. Considering that the mechanism of the curing reaction is a radical polymerization, an inert gas or vacuum is preferred to avoid the deactivation of reaction activation points by oxygen as much as possible. Nitrogen, helium, argon, etc. can be used as the inert gas. Among these, nitrogen is preferred because nitrogen is inexpensive. When an inert gas is filled in an irradiation room, the purity thereof is preferred to be high but an inert gas having a certain purity below which there is a negative impact can be used taking account of desired characteristics, cost and device. Additionally, when an inert gas is sprayed to an irradiated portion on the substrate on which a liquid of application for surface layer is applied, the oxygen density can be lowered by a small amount of inert gas. The amount of sprayed inert gas is preferably from 1 to 200 $m^3$/hour. When the amount is too large, the surface of the surface layer may be non-uniform.

In the present invention, quartz glass, borosilicate glass and PYREX®, etc. can be used. Among these, quartz glass is preferred in terms of transmission of UV light.

Furthermore, in the present invention, a cold filter can be effectively used as the optically transparent member. A cold filter passes light having a wavelength of from about 250 to about 450 nm, which is preferred for the irradiation treatment, in the UV and optical wavelength range, and restrains the passing of light having a wavelength of from about 450 to about 2,000 nm, which has a thermal effect. A cold filter can be formed by, for example, providing several to several tens of deposition layers of dielectric materials, for example, metal oxides, on an optically transparent member, for example, PYREX® and quartz, having a thickness of about 2 mm and is referred to as multiple layer deposition reflection mirror.

In the present invention, since the layer thickness of a surface layer depends on the layer structure of an image bearing member, the thickness is described based on the layer structure described below.

Figure 1B:
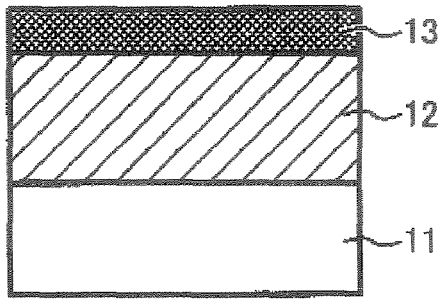

FIG. 1 is a diagram illustrating an example of the image bearing member of the present invention. In this image bearing member, a single layered photosensitive layer having a charge generating function and a charge transport function is provided on a substrate 11. In FIG. 1A, a surface layer 13 is formed as a photosensitive layer. In FIG. 1B, the surface layer 13 is on the surface of a photosensitive layer 12.

Figure 2A:
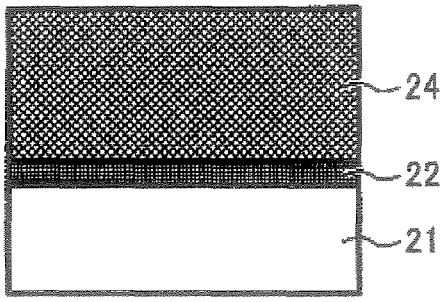
FIG. 2 is a cross section illustrating another example of the image bearing member of the present invention.
Figure 2B:
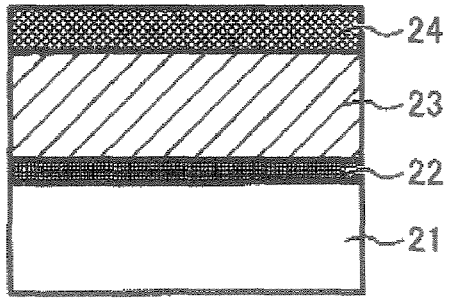

FIG. 2 is a diagram illustrating another example of the image bearing member of the present invention. In the image bearing member, a layered photosensitive layer is formed on a substrate 21 in which a charge transport layer having a charge transport function is accumulated on a charge generating layer 22 having a charge generating function. In FIG. 2A, a surface layer 24 is formed as a photosensitive layer. In FIG. 2B, the surface layer 24 is accumulated on the surface of a charge transport layer 23.

An electroconductive substrate having a volume resistivity of $10^{10}$ Ω·cm is preferably usable as the substrate 11. For example, there can be used plastic or paper having a film form or cylindrical form covered with a metal, for example, aluminum, nickel, chrome, nichrome, copper, gold, silver, and platinum, or a metal oxide, for example, tin oxide and indium oxide by depositing or sputtering. Also a board for med of aluminum, an aluminum alloy, nickel, and a stainless metal can be used. Furthermore, a tube which is manufactured from the board mentioned above by a crafting technique, for example, extruding and extracting, and surface-treatment, for example, cutting, super finishing and grinding is also usable. In addition, the endless nickel belt and the endless stainless belt set forth in JOP S52-36016 can be used as the electroconductive substrate. In addition thereto, a substrate formed of plastic or paper having a film or cylindrical form and an electroconductive layer provided thereon in which electroconductive powder is dispersed in a binder resin can be used as the electroconductive substrate for use in the present invention.

As the electroconductive powder, carbon black, acetylene black, powder of metal, for example, nickel, nichrome, copper, zinc and silver, and metal oxide powder, for example electroconductive zinc oxides and ITO can be used.

As the binder resin in which electroconductive powder is dispersed, there can be used thermoplastic resins, thermal curing reins and optical curing resins, for example, polystyrene, copolymers of styrene and acrylonitrile, copolymers of styrene and butadiene, copolymers of styrene and maleic anhydrate, polyesters, polyvinyl chloride, copolymers of vinyl chloride and vinyl acetate, polyvinyl acetate resins, polyvinylidene chloride resins, polyarylate resins, phenoxy resins, polycarbonate resins, cellulose acetate resins, ethyl cellulose resins, polyvinyl butyral resins, polyvinyl formal resins, polyvinyl toluene resins, poly(N-vinylcarbazole) resins, acryl resins, silicone resins, epoxy resins, melamine resins, urethane resins, phenol resins and alkyd resins.

Such an electroconductive layer can be formed by application of a liquid in which electroconductive powder and a binder resin are dispersed in a solvent, for example, tetrahydrofuran, dichloromethane, methylethyl ketone and toluene.

Also, a substrate formed of a heat contraction tube containing electroconductive powder on which an electroconductive layer is formed can be used as the electroconductive substrate. Specific examples of the materials for the heat contraction tube include, but are not limited to, polyvinyl chloride, polypropylene, polyester, polystyrene, polyvinylidene chloride, polyethylene, chlorinated rubber, and TEFLON®.

Next, the photosensitive layer is described. The photosensitive layer can be of a single-layered structure or a multi-layered structure.

In the case of the multi-layered structure, the photosensitive layer is structured of a charge generating layer having a charge generating function and a charge transport layer having a charge transport function. In the case of the single-layered structure the photosensitive layer has both functions simultaneously.

Below is the description of the photosensitive layer having a multi-layered structure.

The charge generating layer is mainly formed of a charge generating material having a charge generating function. A binder resin can be used in combination, if desired. It is possible to use an inorganic material and an organic material as the charge generating material having a charge generating function.

Specific examples of the inorganic materials include, but are not limited to, crystal selenium, amorphous selenium, selenium-tellurium, selenium-tellurium-halogen, selenium-arsenic compounds and amorphous silicon. With regard to the amorphous silicon, amorphous silicon in which the dangling bonding is terminated by hydrogen atoms and halogen atoms or boron atoms and phosphorus atoms are doped are suitably used.

On the other hand, known materials can be used as the organic materials. Specific examples thereof include, but are not limited to, phthalocyanine based pigments, for example, metal phthalocyanine and non-metal phthalocyanine, azulenium salt pigments, methine squaric acid pigments, azo pigments having carbazole skeleton, azo pigments having triphenyl amine skeleton, azo pigments having dibenzothiophene skeleton, azo pigments having fluorenone skeleton, azo pigments having oxadiazole skeleton, azo pigments having bis stilbene skeleton, azo pigments having distyryl oxadiazole skeleton, azo pigments having distyryl carbazole skeleton, perylene based pigments, anthraquinone based or polycyclic quinone pigments, quinone imine pigments, diphenyl methane based pigments, triphenyl methane based pigments, benzoquinone based pigments, naphthoquinone based pigments, cyanine based pigments, azomethine based pigments, indigoid based pigments, and bisbenzimidazole pigments. These charge generating materials can be used alone or in combination.

Specific examples of the binder resins for use in the charge generating layer include, but are not limited to, polyamides, polyurethanes, epoxy resins, polyketones, polycarbonates, silicone resins, acrylic resins, polyvinyl butyrals, polyvinyl formals, polyvinyl ketones, polystyrenes, poly-N-vinyl carbazoles and polyacrylamides. These binder resins can be used alone or in combination.

In addition, charge transport polymer materials having a charge transport function, for example, polymer materials, for example, polycarbonate resins, polyester resins, polyurethane resins, polyether resins, polysiloxane resins, and acryl resins which have arylamine skeleton, benzidine skeleton, hydrazone skeleton, carbazole skeleton, stilbene skeleton, pyrazoline skeleton, etc.; and polymer materials having polysilane skeleton, can be used as the binder resin of the charge generating layer.

Specific examples of the binder resin include charge transport materials set forth in, for example, JOPs H01-001728, H01-009964, H01-013061, H01-019049, H01-241559, H04-011627, H04-175337, H04-183719, H04-225014, H04-230767, H04-320420, H05-232727, H05-310904, H06-234836, H06-234837, H06-234838, H06-234839, H06-234840, H06-234841, H06-239049, H06-236050, H06-236051, H06-295077, H07-056374, H08-176293, H08-208820, H08-211640, H08-253568, H08-269183, H09-062019, H09-043883, H09-71642, H09-87376, H09-104746, H09-110974, H09-110976, H09-157378, H09-221544, H09-227669, H09-235367, H09-241369, H09-268226, H09-272735, H09-302084, H09-302085 and H09-328539.

Specific examples of the charge transport polymer materials having a charge transport function include, but are not limited to, polysilylenes set forth in JOP S63-285552, H05-19497, H05-70595 and H10-73944.

The charge generating layer can contain a low molecular weight charge transport material. Positive hole transport materials and electron transport materials can be used as the low molecular weight charge transport material.

Specific examples of the charge transport material include, but are not limited to, electron accepting materials, for example, chloroanyl, bromoanyl, tetracyanoethylene, tetracyano quinodimenthane, 2,4,7-trinitro-9-fluorenone, 2,4,5,7-tetranitro-9-fluorenone, 2,4,5,7-tetranitroxanthone, 2,4,8-trinitrothioxanthone, 2,6,8-trinitro-4H-indeno[1,2-b] thiophene-4-one, 1,3,7-trinitro dibenzothiophen-5,5-dioxide, and diphenoquinone derivatives. These can be used alone or in combination.

Specific examples of the positive hole transport materials include, but are not limited to, electron donating materials, for example, oxazole derivatives, oxadiazole derivatives, imidazole derivatives, monoaryl amine derivatives, diaryl amine derivatives, triaryl amine derivatives, stilbene derivatives, α-phenyl stilbene derivatives, benzidine derivatives, diarylmethane derivatives, triaryl methane derivatives, 9-styryl anthracene derivatives, pyrazoline derivatives, divinyl benzene derivatives, hydrazone derivatives, indene derivatives, butadiene derivatives, pyrene derivatives, bis stilbene derivatives, and enamine derivatives. These positive hole transport materials can be used alone or can be mixed in combination for usage.

As a method of forming a charge generating layer, it is possible to use a vacuum thin layer manufacturing method and a casting method from a solution dispersion system.

Specific examples of the vacuum thin layer manufacturing method include, but are not limited to, a vacuum deposition method, a glow discharging decomposition method, an ion plating method, a sputtering method, and a reactive sputtering method and a chemical vacuum deposition (CVD) method. Both inorganic materials and organic materials can be used for forming a charge generating layer.

When a casting method is used, it is possible to form a charge generating layer by applying a suitably diluted liquid dispersion obtained by dispersing an inorganic material or an organic material in a solvent together with a binder resin using a dispersing device, if desired. Specific examples of the solvent include, but are not limited to, tetrahydrofuran, dioxane, dioxolan, toluene, dichloromethane, monochlorobenzene, dichloroethane, cyclohexanone, cyclopentanone, anisole, xylene, methylethylketone, acetone, ethyl acetate and butyl acetate. Specific examples of the dispersing device include, but are not limited to, a ball mill, an attritor, a sand mill, and a bead mill. In addition, if desired, a leveling agent, for example, dimethyl silicone oil and methylphenyl silicone oil, can be added to the liquid dispersion mentioned above. Furthermore, the application mentioned above is performed by a dip coating method, a spray coating method, a bead coating method and a ring coating method.

In the present invention, the thickness of the charge transport layer is preferably from 0.01 to 5 μm and more preferably from 0.05 to 2 μm.

The charge generating layer has a charge transport function and the surface layer for use in the present invention can be used as the charge transport layer. The surface layer can be formed by applying a liquid which contains a radical polymerizable compound with a charge transport structure and a radical polymerizable monomer without a charge transport structure, to a charge transport layer followed by optional drying, and optically curing the liquid. The layer thickness of the surface layer is from 10 to 30 μm and preferably from 10 to 25 μm. When the layer thickness is too thin, the charged voltage may be insufficient. When the layer thickness is too thick, the surface layer may easily be detached from the layer provided under the surface layer due to volume contraction during curing.

In addition, when a surface layer is formed on the surface of a charge transport layer, the charge transport layer can be formed by applying a liquid in which a binder resin and a charge transport material having a charge transport function are dissolved or dispersed in a suitable solvent to a charge generating layer followed by drying.

As the charge transport material, positive hole transport materials, electron transport materials and charge transport polymers illustrated for the charge generating layer can be used. As described above, when a charge transport polymer is used, it is possible to restrain the dissolution of the charge transport layer when a surface layer is applied thereto.

Specific examples of the binder resins include, but are not limited to, thermoplastic resins and thermosetting resins, for example, a polystyrene, a styrene-acrylonitrile copolymer, a styrene-butadiene copolymer, a styrene-anhydride maleic acid copolymer, a polyester, a polyvinyl chloride, a vinyl chloride-vinyl acetate copolymer, a polyvinyl acetate, a polyvinylidene chloride, a polyarylate (PAR) resin, a phenoxy resin, polycarbonate, a cellulose acetate resin, an ethyl cellulose resin, a polyvinyl butyral, a polyvinyl formal, a polyvinyl toluene, a poly-N-vinyl carbazole, an acrylic resin, a silicone resin, an epoxy resin, a melamine resin, an urethane resin, a phenol resin, and an alkyd resin.

The content of the charge transport material is from 20 to 300 parts by weight and preferably from 40 to 150 parts by weight based on 100 parts by weight of a binder resin. A charge transport polymer can be used alone or in combination with a binder resin.

As the solvent, it is possible to use the same solvent as for a charge generating layer. A solvent that can suitably dissolve a charge transport material and a binder resin is preferred. Such a solvent can be used alone or in combination.

As a method of coating a charge transport layer, it is possible to use the same coating method as for a charge generating layer.

In addition, it is possible to add a plastic agent and a leveling agent to a liquid of application for charge transport layer, if desired.

Specific examples of the plasticizing agent include, but are not limited to, dibutyl phthalate and dioctyl phthalate, which are used for typical resins. The addition amount of the plasticizing agent is preferably from 0 to 30 parts by weight based on 100 parts by weight of a binder resin.

Specific examples of the leveling agent include, but are not limited to, silicone oils, for example, dimethyl silicone oil and methyl phenyl silicone oil, and polymers or oligomers having perfluoroalkyl groups in its branch chain. The addition amount of the leveling agent is preferably from 0 to 1 part by weight based on 100 parts by weight of a binder resin.

As described above, the surface layer can be formed by applying a liquid to a charge transport layer followed by optional drying, and optically curing the liquid. The thickness of the surface layer is from 1 to 20 μm and preferably from 2 to 10 μm. A layer thickness that is too thin may cause non-uniform durability due to the layer thickness. When the layer thickness is too thick, the total layer thickness of a charge transport layer and a surface layer thickens, which may result in deterioration of image representation due to the diffusion of charges.

Below is a description about a photosensitive layer in the case of a single layered structure.

A photosensitive layer having a single layer structure has a charge generating function and a charge transport function simultaneously. When the surface layer for use in the present invention further contains a charge generating material having a charge generating function, the surface layer can be used as a photosensitive layer having a single layered structure. The surface layer can be formed by applying a liquid of application for surface layer in which a charge generating material is dispersed together with a radical polymerizable compound which has a charge transport structure and a radical polymerizable monomer which does not have a charge transport structure as in the case of a liquid for forming a charge generating layer to a charge generating layer, followed by optional drying and optically curing the liquid. It is also possible to prepare a liquid for forming a surface layer by using liquid in which a charge generating material is dispersed. The layer thickness of the surface layer is from 10 to 30 μm and preferably from 10 to 25 μm. When the layer thickness is too thin, the charged voltage may be insufficient. When the layer thickness is too thick, the surface layer may easily be detached from the layer provided under the surface layer due to volume contraction during curing.

In addition, when a surface layer is formed on the surface of a photosensitive layer, the photosensitive layer can be formed by application and drying of a liquid in which a binder resin, a radical polymerizable compound with a charge transport structure and a radical polymerizable monomer without a charge transport structure are dissolved or dispersed in a suitable solvent. A plastic agent and a leveling agent can be added to a liquid for forming the photosensitive layer, if desired. The dispersion method of the charging material, the charging materials, the charge transport material, the plastic agent and the leveling agent mentioned for a charge generating layer and a charge transport layer can be used for a surface layer. With regard to the binder resin for a surface layer, the binder resins mentioned for a charge transport layer can be used alone or in combination of the binder resins mentioned for a charge generating layer. In addition, the charge transport polymers mentioned above can be also used to prevent the infusion of the composition of a photosensitive layer to a surface layer. The layer thickness of the photosensitive layer is from 5 to 30 μm and preferably from 10 to 25 μm.

As described above the surface layer can be formed by applying a liquid for forming the surface layer to a photosensitive layer followed by optional drying, and optically curing the liquid. The thickness of the surface layer is from 1 to 20 μm and preferably from 2 to 10 μm. A layer thickness that is too thin may result in a nonuniform layer, which causes non-uniform durability.

The content of the charge generating material in a photosensitive layer is preferably from 1 to 30 weight %. The content of the binder resin therein is preferably from 20 to 80 weight %. The content of the charge transport material therein is preferably from 10 to 70 weight %.

When a surface layer is formed on the surface of a photosensitive layer for the image bearing member of the present invention, it is possible to provide an intermediate layer to restrain the commingling of the composition of the photosensitive layer into the surface layer or to improve the adhesibility with the photosensitive layer. The intermediate layer can restrain the inhibition of the curing reaction and the formation of uneven surface of the surface layer caused by the commingling of the composition into the surface layer. The intermediate layer can also improve the adhesibility between the photosensitive layer and the surface layer.

In general, a binder resin is used for an intermediate layer as its main component. Specific examples of the binder resin include, but are not limited to, polyamides, alcohol soluble nylons, hydrosoluble polyvinylbutyral, polyvinylbutyral, and polyvinyl alcohol. A typical application method can be used to form such an intermediate layer. The layer thickness of the intermediate layer is from 0.05 to 2 μm.

As to the image bearing member of the present invention, an undercoating layer can be provided between the (electroconductive) substrate and the photosensitive layer. In general, such an undercoating layer is mainly formed of a resin. Considering the case in which a photosensitive layer is formed on the intermediate layer (i.e., resin) using a solvent, it is preferred that the resin is hardly soluble in a typically used organic solvent. Specific examples of such resins include, but are not limited to, water soluble resins, for example, polyvinyl alcohol, casein, and sodium polyacrylate, alcohol soluble resins, for example, copolymerized nylon and methoxy-methylated nylon and curing resins which form a three-dimensional mesh structure, for example, polyurethane, melamine resins, phenol resins, alkyd-melamine resins and epoxy resins. In addition, fine powder pigments of metal oxides exemplified by titanium oxide, silica, alumina, zirconium oxide, tin oxide and indium oxide can be added to the undercoating layer to prevent the occurrence of moiré, reduce the residual voltage and so on.

The undercoating layer can be formed by using the same solvents and the same coating methods as those for the photosensitive layer. Furthermore, silane coupling agents, titanium coupling agents and chromium coupling agents can be used in the undercoating layer. In addition, $Al_2O_3$ formed by anodic oxidization, organic compounds, for example, polyparaxylylene(parylene), which are formed by a vacuum thin layer manufacturing method, and inorganic materials, for example, $SiO_2$, $SnO_2$, $TiO_2$, ITO and $CeO_2$ can be also used in the undercoating layer. The thickness of the undercoating layer is from 0 to 5 μm.

In addition, in the present invention, to improve the anti-environment properties, especially to prevent the reduction in the sensitivity and the rise in the residual voltage, an anti-oxidizing agent can be added to each layer of the surface layer, the photosensitive layer (charge generating layer and charge transport layer), the undercoating layer, the Intermediate layer, etc.

Specific examples of such anti-oxidizing agents include, but are not limited to, the following: phenol based compounds, for example, 2,6-di-t-butyl-p-cresol, butylated hydroxyl anisole, 2,6-di-t-butyl-4-ethylphenol, stearyl-β-(3,5-di-t-butyl-4-hydroxyphenyl)propionate, 2,2'-methylene-bis-(4-methyl-6-t-butylphenol), 2,2'-methylene-bis-(4-ethyl-6-t-butylphenol), 4,4'-thiobis-(3-methyl-6-t-butylphenol), 4,4'-butylidenebis-(3-methyl-6-t-butylphenol), 1,1,3-tris-(2-methyl-4-hydoroxy-5-t-butylphenyl)butane, 1,3,5-trimethyl-2,4,6-tris(3,5-di-t-butyl-4-hydroxybenzyl)benzene, tetrakis-[methylene-3-(3',5'-d-t-butyl-4'-hydroxyphenyl)propionate] methane, bis[3,3'-bis(4'-hydroxy-3-t-butylphenyl)butyric acid]glycol ester and tocophenol;

Paraphenylene diamines, for example, N-phenyl-N'-isopropyl-p-phenylene diamine, N,N'-di-(sec-butyl)-p-phenylene diamine, N-phenyl-N-sec-butyl-p-phenylene diamine, N,N'-di-isopropyl-p-phenylene diamine, and N,N'-dimethyl-N,N'-di-(t-butyl)-p-phenylene diamine;

Hydroquinones, for example, 2,5-di-t-octyl hydroquinone, 2,6-didodecyl hydroquinone, 2-dodecyl hydroquinone, 2-dodecyl-5-chloro hydroquinone, 2-t-octyl-5-methyl hydroquinone, 2-(2-octadecenyl)-5-methyl hydroquinone;

Organic sulfur compounds, for example, dilauryl-3,3-thiodipropionate, distearyl-3,3'-thiodipropionate, and ditetradecyl-3,3'-thiodipropionate; and organic phosphorus compounds, for example, triphenyl phosphine, tri(nonylphenyl)phosphine, tri(dinonylphenyl)phosphine, tricresyl phosphine and tri(2,4-dibutylphenoxy)phosphine.

These compounds are known as anti-oxidizing agents for rubber, plastic, and oil and marketed products thereof can easily be obtained.

The addition amount of the anti-oxidizing agent in the present invention is from 0.01 to 10% by weight based on the total amount of the layer to which the anti-oxidizing agent is added.

Next, the image forming method and the image forming apparatus of the present invention are described.

The image forming method and the image forming apparatus of the present invention use the image bearing member of the present invention and perform image forming processes of, for example, charging the image bearing member, irradiating the image bearing member to form a latent electrostatic image thereon, developing the latent electrostatic image with toner, transferring the toner image to an image bearing body (transfer medium), fixing the image and cleaning the surface of the image bearing member. The method in which a latent electrostatic image is directly transferred to a transfer medium followed by the development thereof does not necessarily have the processes mentioned above relating to the image bearing member.

Figure 3:
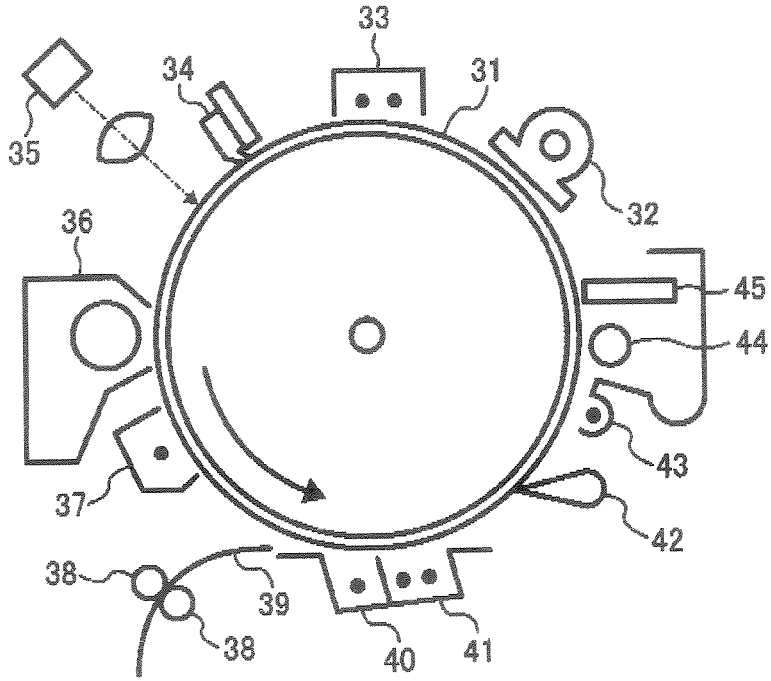
FIG. 3 is a schematic diagram illustrating an example of the image forming apparatus of the present invention.

FIG. 3 is a diagram illustrating the image forming apparatus of the present invention. A charging device 33 is used as the charging device to uniformly charge an image bearing member 31. Also, known charging devices, for example, a corotron device, a scorotron device, a solid discharging element, a needle electrode device, a roller charging device and an electroconductive brush device, can be used.

Especially the structure of the present invention is effective for contact type charging or proximity type charging, by which the composition of an image bearing member may be dissolved. The contact charging system is a charging system in which a charging roller, a charging brush, a charging blade, etc., is brought into contact with an image bearing member. The proximity charging system is such that, for example, a charging roller and an image bearing member are arranged with a space of not greater than 200 μm therebetween, i.e. not in a contact state. This space is from 10 to 200 μm and preferably from 10 to 100 μm. When this space is too wide, the charging tends to be not stable. When the space is too narrow, the surface of a charging device may be contaminated by toner remaining on an image bearing member.

Next, an image irradiation portion 35 is used to form a latent electrostatic image on the image bearing member 31 which is uniformly charged. As the light source, typical luminescent materials, for example, a fluorescent lamp, a tungsten lamp, a halogen lamp, a mercury lamp, a sodium lamp, a luminescent diode (LED), a semi-conductor laser (LD) and electroluminescence (EL) can be used. Various kinds of filters, for example, a sharp cut filter, a band pass filter, an infrared cut filter, a dichroic filter, a coherency filter and a color conversion filter can be used to irradiate the image bearing member 31 with light having only a desired wavelength.

Next, to visualize a latent electrostatic image formed on the image bearing member 31, a developing unit 36 is used. As the developing method, there are a single component developing method and a two component developing method which use a dry toner and a wet developing method which uses a wet toner. When the image bearing member is positively (negatively) charged and image irradiation is performed, a positive (negative) latent electrostatic image is formed on the surface of the image bearing member 31. When this positive (negative) latent electrostatic image is developed with a toner (electric detecting particulates) having a negative (positive) polarity, a positive image is obtained. When the image is developed with a toner having a positive (negative) polarity, a negative image is obtained.

Next, a transfer charging device 40 is used to transfer the visualized toner image on the image bearing member 31 to a transfer medium 39. In addition, to perform a good transferring, a charging device 37 prior to transfer can be used. As a transfer device, an electrostatic transfer system using a transfer charging device or a bias roller, a mechanical transfer system using an adhesive transfer method or a pressure transfer method, and a magnetic transfer system can be used. As the electrostatic transfer system, the same device as the charging device can be used.

Next, as a device to separate the transfer medium 39 from the image bearing member 31, a separation charging device 41 and a separation claw 42 are used. As other separating devices, electrostatic absorption guiding separation, side end belt separation, front end grip transfer, curvature separation, etc. can be used. As the separation charging device 41, the same device as the charging device can be used.

Next, after transfer, to remove the toner remaining on the image bearing member 31, a fur brush 44 and a cleaning blade 45 are used. In addition, to effectively perform cleaning, a charging device 43 prior to cleaning can be used. Other cleaning devices, for example, a web-system device and a magnet brush system device can be also used. These cleaning devices can be used alone or in combination.

Next, if desired, a discharging device is used to remove the latent electrostatic image on the image bearing member 31. A discharging lamp 32 and a discharging charger can be used as the discharge device. The same devices as the irradiation light sources and the charging devices can be used therefor.

In addition to those mentioned above, known devices can be used in the processes of scanning originals, paper feeding, fixing images, discharging recording media, etc., which are performed not in the vicinity of the image bearing member 31.

The image forming apparatus of the present invention can be applied to a photocopying machine, a facsimile machine, a printer, etc. Also a process cartridge can be detachably incorporated in the main body of the image forming apparatus.

Figure 4:
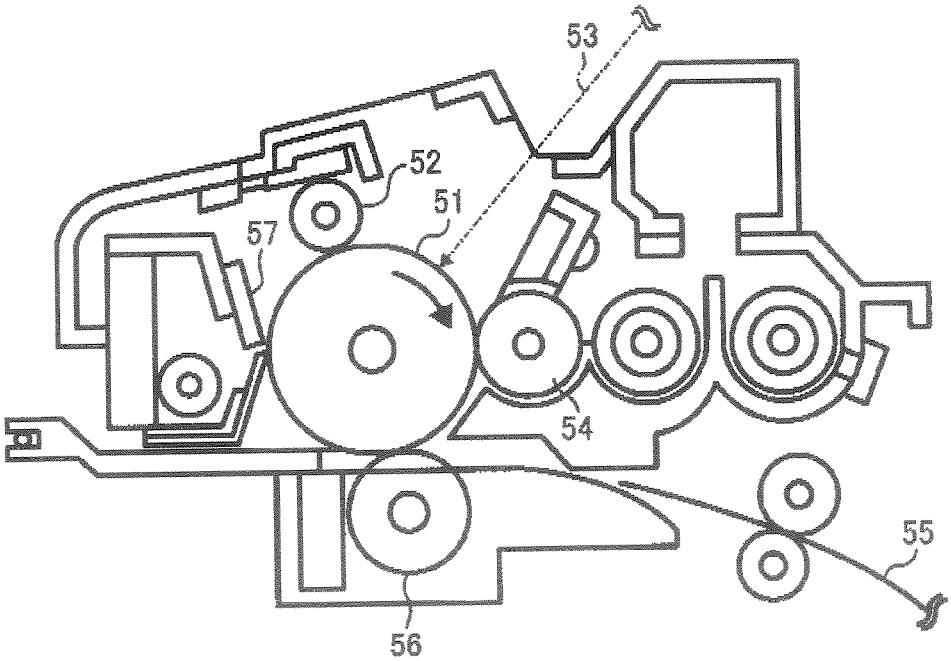
FIG. 4 is a schematic diagram illustrating an example of the process cartridge of the present invention.

FIG. 4 is a diagram illustrating an example of the process cartridge detachably attached to the image forming apparatus of the present invention. The process cartridge is a device or part detachably provided to the main body of an image forming apparatus and includes an image bearing member 51, and at least one of a charging device 52, a developing device 54, the transferring device 56, a cleaning device 57, and a discharging device (not shown). The image bearing member 51 is an example of the image bearing member of the present invention.

The image formation process by the process cartridge illustrated in FIG. 4 is: the image bearing member 51 in rotation along the direction indicated by the arrow is charged with the charging device 52 and irradiated by an irradiating device 53 to form a latent electrostatic image corresponding to the irradiation image on the surface of the image bearing member 51; the latent electrostatic image is developed with toner by the developing device 54; the toner image is transferred to a transfer medium 55 with the transfer device 56; the transferred image is then printed out; on the other hand, the surface of the image bearing member 51 after transfer is cleaned by the cleaning device 57 and discharged by the discharging device (not shown); and all the operations mentioned above continues in a repeated manner.

As apparent from the description above, the image bearing member of the present invention can be applied not only to an a photocopier using the electrophotographic system, but also widely to the applied electrophotographic field including, for example, a laser beam printer, a CRT printer, an LED printer, a liquid crystal printer, and laser plate making.

In the present invention, a radical polymerizable compound having a charge transport structure can be prepared by, for example, the method described in JP 3164426. One specific example thereof is as follows.

(1) Synthesis of Hydroxyl Group Substituted Triarylamine

[Chemical Structure 12]

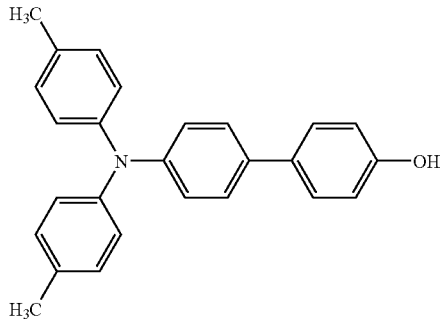

[Chemical Structure 13]

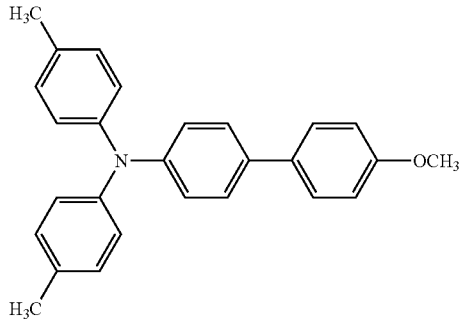

240 ml of sulfolane is added to 113.85 g (0.3 mol) of methoxy group substituted triarylamine represented by the chemical structure 13 illustrated above and 138 g (0.92 mol) of sodium iodide and the mixture is heated to 60° C. in nitrogen air stream. Into the resultant liquid, 99 g (0.91 mol) of trimethyl chlorosilane is dropped for one hour, followed by 4 and a half hours stirring at about 60° C. to completely conduct the reaction. About 1.5 liters of toluene is added to the reaction liquid and the resultant is cooled down to room temperature and repeatedly washed with water and sodium carbonate aqueous solution. Thereafter, the solvent is removed from the obtained toluene solution. The resultant is refined by being subject to a column chromatography treatment (absorbing solvent: silica gel, expanding solvent: a mixture solvent of toluene and ethyl acetate with a volume ratio (toluene to ethyl acetate) of 20 to 1). Cyclohexane is added to the obtained light yellow oil to precipitate crystal. Consequently, 88.1 g (yield ratio: 80.4%) of white crystal of hydroxyl group substituted triarylamine is obtained. The melting point of the obtained product is from 64.0 to 66.0° C. and its elemental analysis (%) is shown in Table 1.

TABLE 1

| | C | H | N |
|---|---|---|---|
| Measured value | 85.06 | 6.41 | 3.73 |
| Calculation value | 85.44 | 6.34 | 3.83 |

(2) Synthesis of the Illustrated Compound No. 1

82.9 g of the hydroxyl group substituted triarylamine is dissolved in 400 ml of tetrahydrofuran. Sodium hydroxide (NaOH: 12.4 g and Water: 100 ml) is dropped to the liquid in nitrogen air stream. The solution is cooled down to 5° C., and 25.2 g (0.272 mol) of chlorinated acrylic acid is dropped thereto in 40 minutes, followed by 3 hour stirring at 5° C. to complete the reaction. This solution of reaction is poured in water and extracted by toluene. The extracted solution is repeatedly washed with sodium hydrogen carbonate and water. Thereafter, the solvent is removed from the obtained toluene solution, followed by column chromatography treatment (absorbing solvent: silica gel, expanding solvent: toluene) for refinement. n-hexane is added to the obtained transparent oil to precipitate crystal. Consequently, 80.73 g (yield ratio: 84.8%) of the illustrated compound No. 1 is obtained. The melting point of the obtained product is from 117.5 to 119.0° C. and its elemental analysis (%) is shown in Table 2.

TABLE 2

| | C | H | N |
|---|---|---|---|
| Measured value | 83.13 | 6.01 | 3.16 |
| Calculation value | 83.02 | 6.00 | 3.33 |

(3) Synthesis of the Illustrated Compound No. 2

In a reaction container equipped with a stirring device, a thermometer and a tap funnel, 38.4 g of 2-hydroxybenzyl alcohol (manufactured by Tokyo Chemical Industry Co., Ltd.) and 80 ml of o-xylene are placed. 62.8 g of triethyl phosphate (manufactured by Tokyo Chemical Industry Co., Ltd.) is dropped to the liquid in nitrogen air stream and the reaction is conducted for one hour. Next, the produced ethanol, o-xylene solvent and non-reacted triethyl phosphite are removed by distillation with a reduced pressure to obtain 66 g (yield ratio: 90%) 2-hydroxybenzyl diethyl phosphonate. The melting point of the obtained product is 120.0° C./1.5 mmHg.

In a reaction container equipped with a stirring device, a thermometer and a tap funnel, 14.8 g of potassium tert-buthoxide and 50 ml of tetrahydrofuran are placed. In nitrogen air stream, a solution in which 9.90 g of 2-hydroxy benzyl diethyl phosphonate and 5.44 g of 4-(N,N-bis(4-methylphenyl)amino)benzaldehyde are dissolved in tetrahydrofuran is slowly dropped to the reaction container at room temperature and the reaction is conducted for 2 hours. Next, while cooling down by water, water is added to the resultant and thereafter 2N hydrochloric acid is added to acidify the resultant. Furthermore, tetrahydrofuran is removed by an evaporator and the obtained coarse product is extracted by toluene. The toluene phase is washed with water, sodium hydrogen carbonate aqueous solution and saturated salt solution in this order. After magnesium sulfide is added, the resultant is dehydrated. Subsequent to filtration, toluene is removed and an oily coarse product is obtained. Subsequent to column refinement by silica gel, the resultant is crystallized in hexane and 5.09 g (yield ratio: 72%) of 2-hydroxy-4'-(N,N-bis(4-methylphenyl)amino)stilbene is obtained. The melting point of the product is 136.0 to 138.0° C.

In a reaction container equipped with a stirring device, a thermometer and a tap funnel, 14.9 g of 2-hydroxy-4'-(N,N-bis(4-methylphenyl)amino)stilbene, 100 ml of tetrahydrofuran and 21.5 g of 12% by weight sodium hydroxide aqueous solution are placed. In nitrogen air stream, 5.17 g of chlorinated acrylic acid is dropped to the reaction container at 5° C. and the reaction is conducted for 3 hours. The reaction liquid is poured into water and extracted by toluene. Subsequent to condensation, column refinement by silica gel is performed. The obtained coarse product is re-crystallized by ethanol to obtain 13.5 g of yellow needle-like crystal of the illustrated compound No. 34 (4'-N,N-bis(4-methylphenyl)amino)stilbene-2-ylacrylate). The melting point of the product is from 104.1 to 105.2° C. and the elemental analysis (%) is shown in Table 3.

TABLE 3

| | C | H | N |
|---|---|---|---|
| Measured value | 86.46 | 6.06 | 3.18 |
| Calculation value | 83.57 | 6.11 | 3.14 |

Having generally described preferred embodiments of this invention, further understanding can be obtained by reference to certain specific examples which are provided herein for the purpose of illustration only and are not intended to be limiting. In the descriptions in the following examples, the numbers represent weight ratios in parts, unless otherwise specified.

EXAMPLES

The present invention is further described referring to Examples but not limited thereto.

Example 1

A liquid for preparing an undercoating layer is prepared by using the following recipe:

| | |
|---|---|
| Alkyd resin (BECKOZOLE 1307-60-EL, manufactured by Dainippon Ink and Chemicals, Incorporated) | 6 parts |
| Melamine resin (SUPER BECKAMINE, G-821-60, manufactured by Dainippon Ink and Chemicals, Incorporated) | 4 parts |
| Titanium oxide (CR-EL, manufactured by Ishihara Sangyo Kaisha Ltd.) | 40 parts |
| Methyl ethyl ketone | 50 parts |

A liquid for forming a charge generating layer is prepared by using the following recipe:

| Bisazo pigment represented by the following chemical structure 14: | |
|---|---|
| [Chemical structure 14] | 2.5 parts |

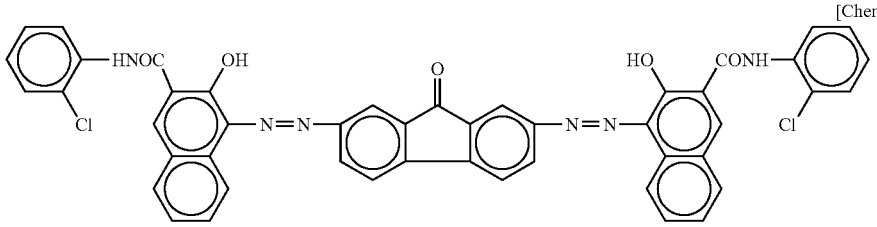

| | |
|---|---|
| Polyvinyl butyral (XYHL, manufactured by Union Carbide Corporation (UCC)) | 0.5 parts |
| Cyclohexane | 200 parts |
| Methylethyl ketone | 80 parts |

A liquid for forming a charge transport layer is prepared by using the following recipe:

| | |
|---|---|
| Bisphenol Z type polycarbonate resin (PANLITE TS-2050, manufactured by Teijin Chemicals Ltd.) | 10 parts |
| Low molecular weight charge transport material represented by the following chemical structure 15: [Chemical Structure 15] | 7 parts |

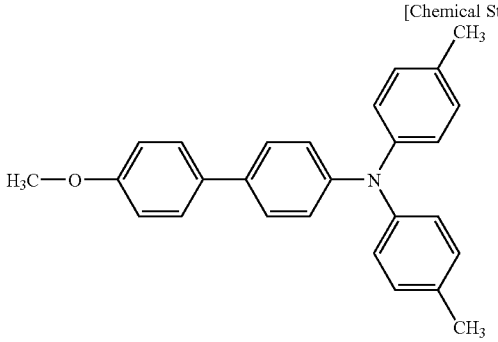

| | |
|---|---|
| Tetrahydrofuran | 100 parts |
| 1% silicone oil tetrahydrofuran solution (KF50-100CS, Shin-Etsu Chemical Co., Ltd.) | 1 part |

A liquid for forming a surface layer is prepared by using the following recipe:

| | |
|---|---|
| Radical polymerizable monomer having charge transport structure (Compound No. 1 illustrated above) | 10 parts |
| Radical polymerizable monomer which does not have a charge transport structure (trimethyl propane triacrylate (KAYARAD TMPTA, manufactured by Nippon Kayaku Co., Ltd.) | 10 parts |
| Photo polymerization initiator (IRGACURE 184, manufactured by Chiba Specialty Chemicals)] | 1 part |
| Tetrahydrofuran | 100 parts |

An undercoating layer having a thickness of 3.5 μm, a charge generating layer having a thickness of 0.2 μm and a charge transport layer having a thickness of 23 μm are formed on an aluminum cylinder having a diameter of 30 mm by applying and drying the liquid for forming the undercoating layer, the liquid for forming the charge generating layer and the liquid for forming charge transport layer to the aluminum cylinder in this order with a dip coating method.

Figure 5:
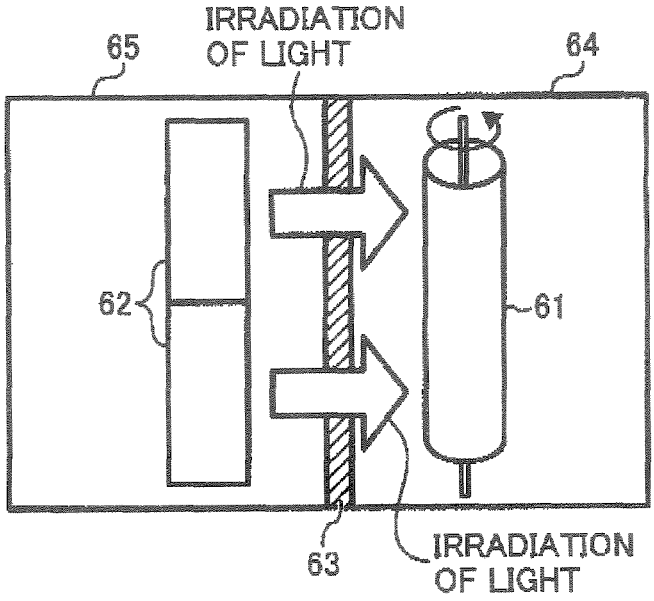
FIG. 5 is a diagram illustrating the structure of the UV lamp system of Example 1 described later.

The liquid for forming the surface layer is spray-coated on the charge transport layer (hereinafter referred to as the image bearing member precursor). An image bearing member precursor 61 is irradiated with light in an irradiation room 64 while rotating the image bearing member precursor 61. The light is emitted from a UV lamp system (Model F600S, manufactured by Fusion Co., Ltd, light source portion: model I600M, power source portion: Model P600M) illustrated in FIG. 5. The irradiation conditions are as follows: a UV lamp 62 provided in a light source room 65 is a V bulb (two connected in series), the power source is 160 W/cm, the illuminance is at least 300 mW/cm$^2$, the time of irradiation of UV light having a wavelength of 365 nm on the surface of the image bearing member precursor 61 is 30 second and the surface temperature thereof is controlled and kept at 70° C. or lower by water cooling. As an optically transparent member 63, a quartz glass (manufactured by Fujiwara Scientific Company Co., Ltd.) having a thickness of 2 mm with ES grade. The atmosphere in the irradiation room 64 is air. The transmission factor of quartz glass for light having a wavelength from 190 to 2,000 nm is from 80 to 90%. The image bearing member precursor 61 is dried for 30 minutes at 130° C. and image bearing member No. 1 having a surface layer having a thickness of 5.0 μm is obtained. The illuminance of UV light having a wavelength of 365 nm is measured by a UV power meter UIT-150 and a separate type photoreceiver UVD-S356 (both manufactured by Usio Inc.).

Example 2

Figure 6:
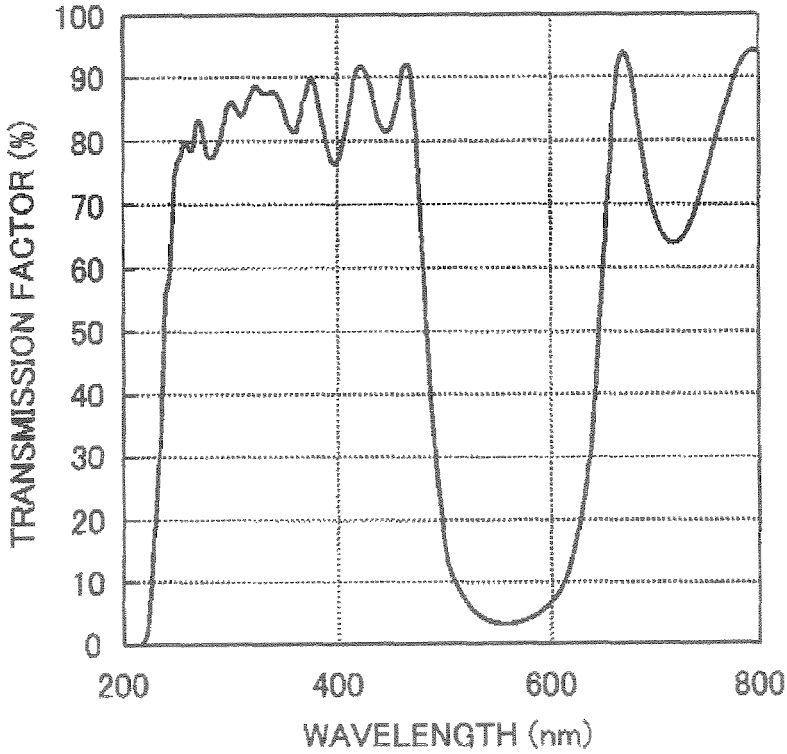
FIG. 6 is a graph illustrating the relationship between the wavelength and the transmission factor characteristics of the cold filter of Example 2 described later.

Image bearing member No. 2 is manufactured in the same manner as in Example 1 except that a cold filter is used as the optically transparent member 63. FIG. 6 is a graph illustrating the relationship between the wavelength and the transmission factor characteristics of the cold filter.

Example 3

Image bearing member No. 3 is manufactured in the same manner as in Example 2 except that the oxygen density of the atmosphere in the irradiation room 64 is not greater than 2.0%. Nitrogen is filled in the irradiation room 64 at 7.5 m$^3$/hour for two minutes to make the oxygen density to be not greater than 2.0%. The oxygen density is measured by using an oxygen monitor (OM-25MS10, manufactured by As One Corporation) to keep the oxygen density in the irradiation room 64 not greater than 2.0%.

Example 4

Figure 7A:
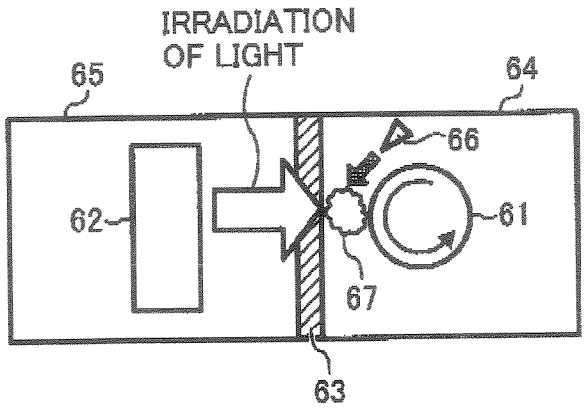
FIG. 7A is an overhead view of the UV lamp system and FIG. 7B is a view of the irradiation room from a side.
Figure 7B:
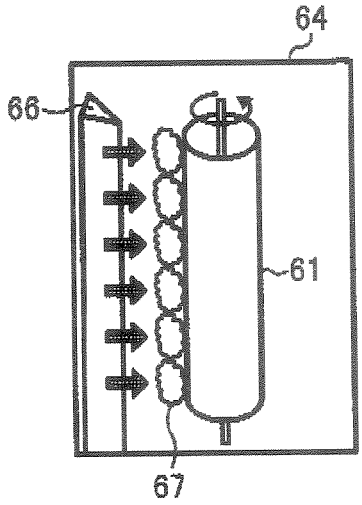

Image bearing member No. 4 is manufactured in the same manner as in Example 2 except that nitrogen 67 is sprayed from a nozzle 66 to the irradiated portion of the image bearing member precursor 61 at 20 m$^3$/hour in the irradiation room 64 as illustrated in FIG. 7.

Example 5

Image bearing member No. 5 is manufactured in the same manner as in Example 4 except that the compound No. 34 illustrated above is used as the radical polymerizable monomer having a charge transport structure.

Example 6

Image bearing member No. 6 is manufactured in the same manner as in Example 4 except that the compound No. 21 illustrated above is used as the radical polymerizable monomer having a charge transport structure.

Example 7

Image bearing member No. 7 is manufactured in the same manner as in Example 4 except that a mixture monomer of KAYARAD TMPTA and caprolactone modified dipentaerythritol hexaacrylate KAYARAD DPCA-120 (both manufactured by Nippon Kayaku Co., Ltd.) is used with a mixture weight ratio of 1 to 1 as the radical polymerizable monomer which does not have a charge transport structure.

Example 8

Image bearing member No. 8 is manufactured in the same manner as in Example 4 except that a mixture monomer of KAYARAD TMPTA and dipentaerythritol hexaacrylate KAYARAD DPHA (both manufactured by Nippon Kayaku Co., Ltd.) is used with a mixture weight ratio of 1 to 1 as the radical polymerizable monomer which does not have a charge transport structure.

Comparative Examples 1 to 5

Image bearing members of Comparative Examples 1 to 5 are manufactured in the same manner as in Examples 1 and 5 to 8 except that the optically transparent member is not used.

(Evaluation Method and Evaluation Result)

As described above, two image bearing members are manufactured for each Example and Comparative Example. One image bearing member of the two manufactured is cut by a thread saw and dipped in tetrahydrofuran to separate the surface layer. The optical transmission factor of the surface layer for light having a wavelength of 25 nm longer than an absorption end wavelength of photo-absorption spectrum of the surface layer prior to optical curing is measured by a spectral photometer (UV3100, manufactured by Shimadzu Corporation). The stripped surface layer is attached to a quartz cell for measurement when the transmission factor thereof is measured. The layer thickness in converted id 8 μm. The results are shown in Table 4.

TABLE 4

| | Radical polymerizable monomer having a charge transport structure | Absorption end wavelength (nm) | Optical transmission factor of light having a wavelength of 25 nm longer than absorption end wavelength (%) |
|---|---|---|---|
| Example 1 | No. 1 | 388 | 65 |
| Example 2 | No. 1 | 388 | 67 |
| Example 3 | No. 1 | 388 | 70 |
| Example 4 | No. 1 | 388 | 70 |
| Example 5 | No. 34 | 418 | 69 |
| Example 6 | No. 21 | 396 | 68 |

TABLE 4-continued

| | Radical polymerizable monomer having a charge transport structure | Absorption end wavelength (nm) | Optical transmission factor of light having a wavelength of 25 nm longer than absorption end wavelength (%) |
|---|---|---|---|
| Example 7 | No. 1 | 388 | 71 |
| Example 8 | No. 34 | 418 | 72 |
| Comparative Example 1 | No. 1 | 388 | 51 |
| Comparative Example 2 | No. 34 | 418 | 55 |
| Comparative Example 3 | No. 21 | 396 | 54 |
| Comparative Example 4 | No. 1 | 388 | 57 |
| Comparative Example 5 | No. 34 | 418 | 58 |

The optical transmission factor of light having a wavelength of 25 nm longer than the absorption end wavelength of the photo-absorption spectrum of the surface layer prior to optical curing is not less than 65% for the image bearing members of Examples. The transmission factor for the image bearing members of Comparative Examples is less than 65% and the surface thereof has a brownish color.

Centerline surface roughness Ra (JIS B0601:1982) is measured by a surface texture and contour measuring instrument (SURFCOM 1400D, manufactured by Tokyo Seimitsu Co., Ltd.). The result is shown in Table 5.

TABLE 5

| | Centerline surface roughness Ra (μm) |
|---|---|
| Example 1 | 0.30 |
| Example 2 | 0.25 |
| Example 3 | 0.20 |
| Example 4 | 0.20 |
| Example 5 | 0.24 |
| Example 6 | 0.29 |
| Example 7 | 0.25 |
| Example 8 | 0.20 |
| Comparative Example 1 | 0.50 |
| Comparative Example 2 | 0.46 |
| Comparative Example 3 | 0.40 |
| Comparative Example 4 | 0.42 |
| Comparative Example 5 | 0.41 |

The image bearing members of Comparative Examples have a low surface smoothness. This is considered to be because, since the light source room 65 and the irradiation room 64 are not separated, the heat from the light source room 65 causes the evaporation of the solution and side effects so that the curing is not uniformly conducted and therefore a non-uniform cured layer is formed.

The image bearing member of Examples has a sufficient surface smoothness for cleaning.

The image bearing member of Examples and Comparative Examples is implemented in a process cartridge, which is implemented in an image forming apparatus (IPSiO Color 7100, manufactured by Ricoh Co., Ltd.) adopt in AC non-contact roller system as the charging system and having a semi-conductor laser having a wavelength of 655 nm as the image irradiation light source. After the voltage at a darkness portion is set to be 700 (—V), 50,000 images are continuously printed and the abraded quantity and the voltage in the apparatus are evaluated. The layer thickness of the image bearing member is measured by an eddy current type layer thickness measuring device (manufactured by Fischer Instruments KK). The result is shown in Table 6.

TABLE 6

| | Abraded quantity after 50,000 image print (μm) | Voltage in the apparatus (−V) Initial Voltage (dark) | Initial Voltage (light) | After 50,000 image print Voltage (dark) | After 50,000 image print Voltage (light) |
|---|---|---|---|---|---|
| Example 1 | 1.10 | 700 | 95 | 680 | 100 |
| Example 2 | 1.05 | 700 | 90 | 685 | 95 |
| Example 3 | 1.05 | 700 | 85 | 690 | 90 |
| Example 4 | 1.00 | 700 | 85 | 690 | 90 |
| Example 5 | 1.00 | 700 | 80 | 680 | 85 |
| Example 6 | 1.05 | 700 | 90 | 685 | 95 |
| Example 7 | 0.90 | 700 | 80 | 690 | 85 |
| Example 8 | 0.90 | 700 | 80 | 690 | 85 |
| Comparative Example 1 | 1.20 | 700 | 115 | 670 | 125 |
| Comparative Example 2 | 1.10 | 700 | 120 | 670 | 135 |
| Comparative Example 3 | 1.15 | 700 | 115 | 675 | 125 |
| Comparative Example 4 | 1.00 | 700 | 120 | 675 | 130 |
| Comparative Example 5 | 1.00 | 700 | 110 | 680 | 120 |

The image bearing members of Examples have a stable and good voltage in the apparatus at the initial stage and after 50,000 image prints. In contrast, the image bearing members of Comparative Examples have a high voltage (light) at a bright portion at the initial stage and a significant rise thereof after 50,000 image prints. The image bearing members of Comparative Examples tend to have a relatively large amount of abraded quantity in comparison with the image bearing members of Examples.

This is considered to be because, since the light source room 65 and the irradiation room 64 are not separated, the heat from the light source room causes the evaporation of the solution and side reaction so that charge trap sites are formed, the charge transport material is damaged by the side reaction and the inside of the surface layer is not cured well.

This document claims priority and contains subject matter related to Japanese Patent Application No. 2005-374936 filed on Dec. 27, 2006, the entire contents of which are incorporated herein by reference.

Having now fully described the invention, it will be apparent to one of ordinary skill in the art that many changes and modifications can be made thereto without departing from the spirit and scope of the invention as set forth therein.

What is claimed as new and desired to be secured by Letters Patent of the United States is:

1. An image bearing member comprising:

a substrate; and a surface layer formed by optically curing at least a radical polymerizable compound with a charge transport structure and a radical polymerizable monomer without a charge transport structure, wherein a transmission factor of the surface layer for light having a wavelength of 25 nm longer than an absorption end wavelength of a photo-absorption spectrum of the surface layer prior to optical curing is not less than 65%, and the image bearing member has a centerline surface roughness Ra (JIS B0691:1982) from 0.2 to 0.3 μm.

2. The image bearing member according to claim 1, wherein a number of radical polymerizable functional groups of the radical polymerizable compound with a charge transport structure is 1.

3. The image bearing member according to claim 1, wherein a number of radical polymerizable functional groups of the radical polymerizable compound without a charge transport structure is at least 3.

4. The image bearing member according to claim 1, wherein the radical polymerizable compound with a charge transport structure and the radical polymerizable compound without a charge transport structure each, independently, comprise an acryloyloxy group or a methacryloyloxy group.

5. The image bearing member according to claim 1, wherein the radical polymerizable compound with a charge transport structure comprises a triarylamine structure.

6. The image bearing member according to claim 1, wherein a charge generating layer, a charge transport layer and the surface layer are accumulated on the substrate in this order.

7. The image bearing member according to claim 1, wherein the radical polymerizable compound having a charge transport structure is a compound having chemical structure 1 or chemical structure 2:

Chemical structure 1

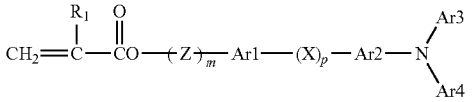

Chemical structure 2

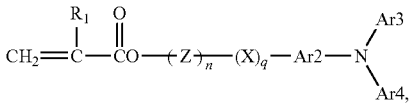

wherein $R_1$ represents hydrogen atom, a halogen atom, an alkyl group, an aralkyl group, an aryl group, cyano group, nitro group, an alkoxy group, —$COOR_7$, —COY (Y represents a halogen group) or $CONR_8R_9$;

$R_7$ represents hydrogen atom, a substituted or non-substituted alkyl group, a substituted or non-substituted aralkyl group or a substituted or non-substituted aryl group;

$R_8$ and $R_9$ each, independently, represent hydrogen atom, a halogen atom, a substituted or non-substituted alkyl group, a substituted or non-substituted aralkyl group or a substituted or non-substituted aryl group;

$Ar_1$ and $Ar_2$ each, independently, represent a substituted or non-substituted arylene group;

$Ar_3$ and $Ar_4$ each, independently, represent a substituted or non-substituted aryl group;

X represents a substituted or non-substituted alkylene group, a substituted or non-substituted cycloalkylene group, a substituted or non-substituted oxyalkylene group, oxy group, thio group or a vinylene group;

Z represents a substituted or non-substituted alkylene group, a substituted or non-substituted oxyalkylene group or a combinational functional group of an oxyalkylene group and a carbonyl group;

p and q each, independently, represent 0 or 1; and m and n each, independently, represent an integer of from 0 to 3.

8. The image bearing member according to claim 1, wherein the radical polymerizable monomer having a charge transport structure is a compound of chemical structure 5:

Chemical structure 5

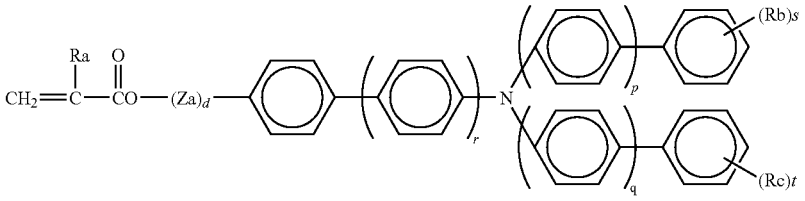

wherein d, r, p, q each, independently, represent 0 or 1;

s and t each, independently, represent an integer of from 0 to 3;

Ra represents hydrogen atom or methyl group;

Rb and Rc each, independently, represent an alkyl group having 1 to 6 carbon atoms; and Za represents methylene group, ethylene group, —$CH_2CH_2O$—, —$CHCH_3CH_2O$—, or —$C_6H_5CH_2CH_2$—.

9. An image forming apparatus comprising:

the image bearing member of claim 1;

a charging device configured to charge the image bearing member;

an irradiating device configured to irradiate the image bearing member with light to form a latent image thereon;

a developing device configured to develop the latent image with a toner;

a transfer device configured to transfer the developed image to a recording medium; and a cleaning device configured to clean the surface of the image bearing member.

10. A process cartridge detachably attached to a main body of an image forming apparatus comprising:

an image bearing member of claim 1; and at least one device selected from a group consisting of a charging device, a developing device, a transfer device, a cleaning device and a discharging device.

11. A method of manufacturing an image bearing member comprising:

applying a liquid comprising a radical polymerizable compound with a charge transport structure and a radical polymerizable monomer without a charge transport structure to a substrate of the image bearing member; and curing the radical polymerizable compound with a charge transport structure and the radical polymerizable monomer without a charge transport structure by irradiating the substrate on which the liquid is applied in an irradiation room with light emitted from a light source provided in a light source room, wherein the light source room comprising the light source that emits the light is separated from the light irradiation room by an optical transparent member.

* * * * *